US005214432A

United States Patent [19]

Kasevich et al.

[11] Patent Number: 5,214,432

[45] Date of Patent: May 25, 1993

[54] BROADBAND ELECTROMAGNETIC ENERGY ABSORBER

[75] Inventors: Raymond S. Kasevich, Weston; Michael Kocsik, Ashland; Michael Heafey, Woburn, all of Mass.

[73] Assignee: Chomerics, Inc., Bedford, Mass.

[21] Appl. No.: 489,924

[22] Filed: Feb. 16, 1990

Related U.S. Application Data

[63] Continuation-in-part of Ser. No. 177,518, Apr. 11, 1988, which is a continuation-in-part of Ser. No. 10,448, Feb. 3, 1987, abandoned, which is a continuation-in-part of Ser. No. 934,716, Nov. 25, 1986, abandoned.

[51] Int. Cl.[5] ..... H01Q 17/00

[52] U.S. Cl. ..... 342/3; 342/4

[58] Field of Search ..... 342/1, 2, 3, 4

[56] References Cited

U.S. PATENT DOCUMENTS

| | | | |
|---|---|---|---|
| 3,315,261 | 4/1967 | Wesch | 342/4 |
| 3,427,619 | 2/1969 | Wesch et al. | 342/3 |
| 3,754,255 | 8/1973 | Suetake et al. | 342/4 |
| 4,888,590 | 12/1989 | Chase | 342/3 |

*Primary Examiner*—T. H. Tubbesing

*Attorney, Agent, or Firm*—Wolf, Greenfield & Sacks

[57] ABSTRACT

A radar absorbing material comprising multiple layers integrated to form a thin, flexible, and lightweight structure. The material includes a substrate having disposed thereon absorber elements that are resistively loaded to enable one to construct a device relatively small and thin size. The broadbanding of the device is carried out by multilayering concepts in which different size antenna patterns are multilayered with each layer designed to absorb frequencies in a specified range. The absorber elements are selected for their intrinsic impedance properties and preferrably be polarization insensitive. These absorber elements are disposed in a random and preferrably aperiodic pattern.

20 Claims, 25 Drawing Sheets

BROADBAND ELECTROMAGNETIC ENERGY ABSORBER

RELATED APPLICATIONS

This application is a continuation-in-part of application Ser. No. 07/177,518 filed Apr. 11, 1988, which, in turn, a continuation-in-part of application Ser. No. 07/010,448 filed Feb. 3, 1987, now abandoned, which, in turn, is a continuation-in-part of application Ser. No. 06/934,716 filed Nov. 25, 1986, now abandoned.

BACKGROUND OF THE INVENTION

The present invention relates in general to radar absorbing materials, particularly broadband electro-magnetic energy absorbers. More particularly, the present invention relates to an electromagnetic energy absorber that is thin, flexible, lightweight, and preferably operates in a frequency band of 2–18 GHz with less than −15 dB reflectivity. Even more particularly, this invention relates to an improved absorber element configuration with improved broadband and reflectivity characteristics and attendant suppression of grating lobe signals.

Two basic forms of radar absorbers are referred to in the prior art as a Salisbury screen and a Dallenbach layer. The Salisbury screen is a resonant absorber formed by placing a resistive sheet on a low dielectric constant spacer in front of a metal plate. The Dallenbach layer consists of a homogeneous lossy layer backed by a metal plate. The Salisbury screen has found some limited usage, but is generally ineffective for broadband applications. One of the problems with the Dallenbach layer is the difficulty in providing the proper match of materials. Also, the Dallenbach layer does not provide sufficient bandwidth.

Much effort has been carried out in the past in an attempt to extend the bandwidth of radar absorbers through the use of multiple layers. In this regard, see by way of example, U.S. Pat. No. 2,951,247 to Halpern, et al, U.S. Pat. No. 2,992,425 to Pratt and U.S. Pat. No. 2,771,602 to Kuhnhold. Also refer to British patent 665,747.

In these prior art absorbers, the intention of the use of multiple layers is to slowly change the effective impedance from free space to zero ohms with distance into the material so as to minimize reflections or to provide an input impedance that matches that of free space as closely as possible over a selected range of frequencies. There are, generally speaking, two different types of multi-layer absorbers that are common in the art. These are referred to as the Jaumann absorber, and graded dielectric absorber. All of these absorbers require the use of multiple layers and are typically relatively thick. Existing broadband radar absorbing materials require thickness of at least one or two inches to achieve any significant bandwidth. Also, the manufacturing process is relatively complex because of the multi-layering of different materials that are used to obtain the broadband enhancement. One example of a commercially available graded dielectric absorber is one made by Emerson & Cuming. This is referred to as their Model No. AN-74 which is a three-layer foam absorber that is over one inch thick.

Accordingly, it is an object of the present invention to provide an improved radar absorbing material that has excellent broadband characteristics and that is yet thin, preferably flexible and light in weight.

Another object of the present invention is to provide an improved radar absorbing material that is in particular usable over a frequency range of 2–18 GHz with preferred reflectivity of less than −15 dB.

A further object of the present invention is to provide a radar absorber that is relatively simple in construction and that can be easily manufactured in production quantities at relatively low cost.

A further object of the present invention is to provide an improved radar absorber in which the overall material thickness is made quite small by employing a process that includes the step of printing antenna patterns using a preferred resistive ink and wherein the antenna patterns may be printed using silk screening techniques.

Another object of the present invention is to provide an improved radar absorber that is characterized by its broadband absorption, and yet is carried out with a thin structure at least an order of magnitude thinner than one inch.

A further object of the invention is to provide an improved radar absorber that is in particular adapted for high temperature applications.

Still another object the present invention is to provide an improved electromagnetic energy absorber that is in particular characterized by an improved absorber element configuration that provides improved broadband and reflectivity characteristics along with attendant suppression of grating lobe signals.

A further object of the present invention is to provide an improved absorber element configuration in accordance with the preceeding object and in which the absorber elements are disposed are randomly absent any substantial alignment of elements so as to prevent grating lobe enhancement occasioned by periodicity of placement of the absorber elements.

SUMMARY OF THE INVENTION

To accomplish the foregoing and other objects, features and advantages to the invention, there is provided, in accordance with one aspect of the present invention, a radar absorbing apparatus for absorbing an electromagnetic energy wave having frequency signal content in a frequency range including 2–18 GHz. The apparatus comprises an electrically conductive reflector means that may comprise a metallic layer, and an array that is comprised of a plurality of discrete absorber elements. The absorber elements may comprise, for example, dipole or spiral elements. Means are provided for supporting the absorber elements from and in front of the electrically conductive reflector means. The elements are disposed in at least a first planar array. In accordance with the invention, means are provided for resistively loading each of the absorber elements. The resistive loading referred to herein may be accomplished by means of providing a resistor at a terminal of the element. Alternatively, a resistively loaded element may be achieved by printing the element on a dielectric substrate with a resistively loaded ink. The array patterns may easily be fabricated on the dielectric substrate using silk screen or other transfer methods. The elements furthermore are selected from a class of broadband antenna elements known as frequency independent antennas.

In accordance with a further aspect of the present invention, there is provided a radar absorber that is designed for broadband absorption. In accordance with the invention, there is provided for multi-layering of different size element patterns, one particular size for a given layer, to achieve a broadband three-dimensional array with each layer adapted to absorb frequencies in a specified range because of the particular geometry employed for that particular layer. The overall material thickness is relatively small because of the preferred use of resistive loading as referred to hereinbefore and also because of the use of the printing of the element patterns using a resistive ink on an appropriate dielectric substrate.

In accordance with the invention, the broadband radar absorbing apparatus comprises an electrically conductive reflector means, a first array comprised of a plurality of discrete absorber elements, and means for supporting the first array from and in front of the electrically conductive reflector means and in at least a first planar configuration. The first array is adapted for absorption over a first predetermined frequency segment included in the frequency range. The multi-layering is accomplished by at least a second array also comprised of a plurality of discrete absorber elements along with means for supporting the second array spaced from the first array and remote from the reflector means. The second array is adapted for absorbing electromagnetic energy in a second frequency segment included in the frequency range. By providing still further arrays, a substantially wide frequency spectrum may be covered.

In accordance with still a further aspect of the present invention, there is provided a radar absorber that is optimized for broadband absorption while at the same time is adapted to be constructed in a relatively thin configuration. This is carried out in the present invention by providing in a single layer, different forms, and in particular, different sizes, of absorber elements, each different form or size essentially being tuned at different frequencies so as to provide broadbanding even in a single array layer. In this way there can be provided bandwidth enhancement using even a single layer configuration. In this regard, there is provided a radar absorbing apparatus for absorbing an electro-magnetic energy wave having the frequency signal content in a frequency range including 2–18 GHz. This apparatus comprises an electrically conductive reflector means, an array comprised of a plurality of discrete absorber elements, and means for supporting the elements from and in front of the electrically conductive reflector means and in a planar configuration. The array includes elements of first and second different size. The first size elements are adapted for absorption primarily over a first frequency segment included in the frequency range. The second size elements are adapted for absorption primarily over a second frequency segment included in the frequency range. By way of example, these two different size absorber elements may both be different size spiral elements. The elements of first size are preferably interspersed with the elements of second size. Also described are configurations in which the first size elements are trapezoidal and the second size elements are spiral. Another configuration illustrates the first size elements as being zig-zag elements while the second size elements are spiral.

In accordance with still another aspect of the present invention, spiral absorber configurations are described employing both separate and continuous spirals of varying spiral spacing. One embodiment has an open central segment in the spiral while still another embodiment employs a ferrite disk at the center of the spiral. A further configuration is one in which there is provided a main spiral configuration altered to receive plural smaller spiral configurations.

In accordance with still a further aspect the present invention, the absorber elements are disposed in a random pattern array. This random pattern array is arranged so that there is an interuption in the alignment of these absorber elements. This is so that there will not be any substantial periodicity of placement of the absorber elements so as to thereby minimize grating lobe signals.

BRIEF DESCRIPTION OF THE DRAWINGS

Numerous other objects, features, and advantages of the invention should now become apparent upon a reading of the following detailed description taken in conjunction with the accompanying drawing, in which.

DETAILED DESCRIPTION

In accordance with the present invention, there is provided a thin, flexible, lightweight and broadband radar absorbing material. The apparatus that is described herein is in particular designed for operation in the frequency range of 2–18 GHz and is adapted to provide operation with reflectivities of less than −15 dB. Also, this invention relates to an improved absorber element absorber element configuration with improved broadband and reflectivity characteristics and attendant suppression of grating lobe signals.

The apparatus to be described herein is characterized by several important features. One feature relates to a resistive loading technique to enable one to construct the device in relatively small and thin size. Another concept is a broadbanding technique that is carried out by multi-layering concepts. In this regard, different size antenna patterns are multi-layered to achieve a broadband three-dimensional antenna array in which each layer is designed to absorb frequencies in a specified range because of the particular antenna geometry employed for that layer. In accordance with still a further feature of the present invention and in an effort to minimize grating lobes the absorber elements are disposed in a random pattern preferably one that is aperiodic and furthermore in which the elements are preferably disposed at spacing of less than ½ wavelength in the frequency band of interest.

Figure 6:
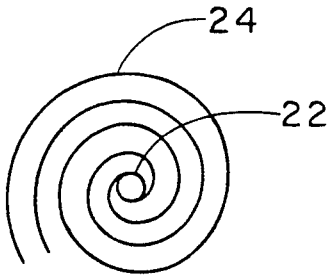
FIG. 6 is a fragmentary view illustrating one means by which the element may be resistively loaded as specifically applies to a spiral configuration.

In accordance with the invention it is furthermore noted that the overall material thickness is made small by printing the absorber patterns, preferably using a resistive ink in which the loading is substantially uniform throughout the pattern, or a highly conductive ink in combination with a discrete load. In the case of using a resistive ink for the absorber pattern, the absorber may be either open-circuited or short-circuited at the absorber feed gap. In the case of using a highly conductive ink, the resistive loading is at the feed gap such as illustrated in FIG. 6. The absorber patterns are printed on an appropriate substrate using silk screening or other transfer methods. It is noted herein that, although reference has made previously to antenna patterns, for the most part hereinafter the elements are referred to as absorber elements as this is more descriptive of their intended use.

Figure 1:
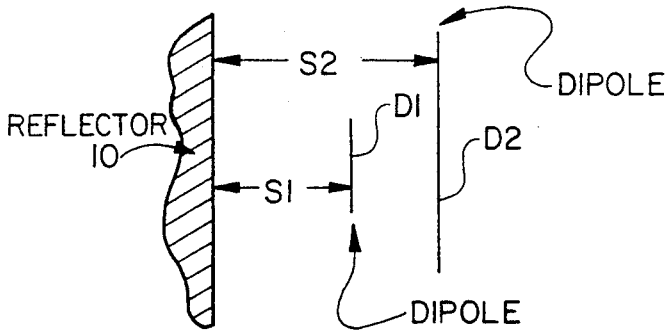
FIG. 1 is a schematic diagram illustrating the principles of the present invention as they relate to multiple absorber arrays in association with a reflector.

Reference is now made to the schematic diagram of FIG. 1 which shows a metal sheet 10 forming a reflector having disposed in front thereof, dipoles D1 and D2 at respective spacings S1 and S2 from the reflector surface. It is noted that the dipole D1 is of shorter length than the dipole D2. From antenna theory and considering only the dipole D1, it is known that a half wavelength dipole antenna in front of a metal sheet such as the reflector 10 has zero radiation away from the sheet when the dipole is spaced one-half wavelength from the sheet or in other works when the distance S1 is one-half wavelength of the particular electromagnetic energy signal. The zero field intensity came about by interference of the waves, one reflected from the plate 10 and one transmitted by the antenna. By reciprocity, if the dipole is receiving electromagnetic energy in the form of a plane wave, it re-radiates zero power at this one-half wavelength spacing.

Now, in accordance with the present invention, it has been found that if the dipole is loaded with a resistor, there also is provided substantially zero gain, but at a spacing on the order of or less than one-tenth wavelength. Thus, also by reciprocity, if the closely spaced dipole is receiving electromagnetic energy in a plane wave, it re-radiates zero power at this one-tenth wavelength or less spacing.

Figure 7:
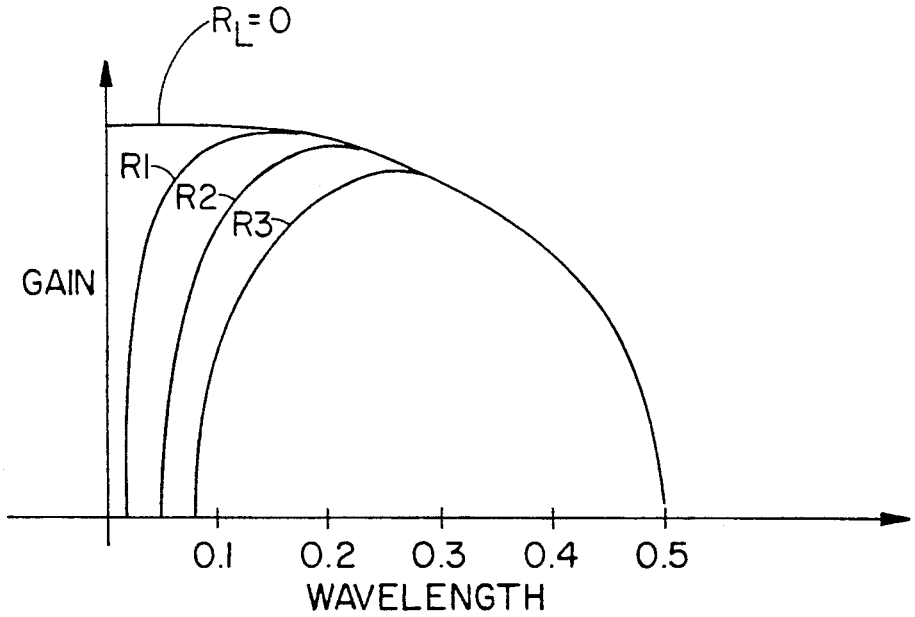
FIG. 7 is a graph of frequency or wavelength versus gain that is important in illustrating one of the principles of the present invention that enables reduced size absorbers.

In connection with the resistive loading of the antenna, refer to FIG. 7 which is a diagram of wavelength versus gain showing a family of curves relating to different load resistances. In FIG. 7 it is noted that the curve for zero load resistance is essentially maintained at a constant value for small wavelengths. Therefore, it is not possible to achieve zero re-radiated power for very small spacings between the antenna and ground plane under the condition of the load resistance being zero. On the other hand, the other curves indicate that as the resistive loading increase in value, then there will be zero gain and thus zero re-radiation also at spacings generally less than one-tenth wavelength. Reference will be hereinafter to techniques for carrying out the resistive loading of the antenna element.

In addition to the concepts of reducing the thickness of the absorber by the resistive loading technique, a broadband apparatus is provided by the multi-layering technique of the present invention. This is schematically illustrated in FIG. 1 by showing a first dipole D1 that may be considered as in a first layer and a second dipole D2 that may be considered as in a second layer. It is noted that the dipole D2 is spaced further from the reflector than the dipole D1. The dipole D1 relates to the absorption of a higher frequency signal than that of dipole D2.

Figure 2:
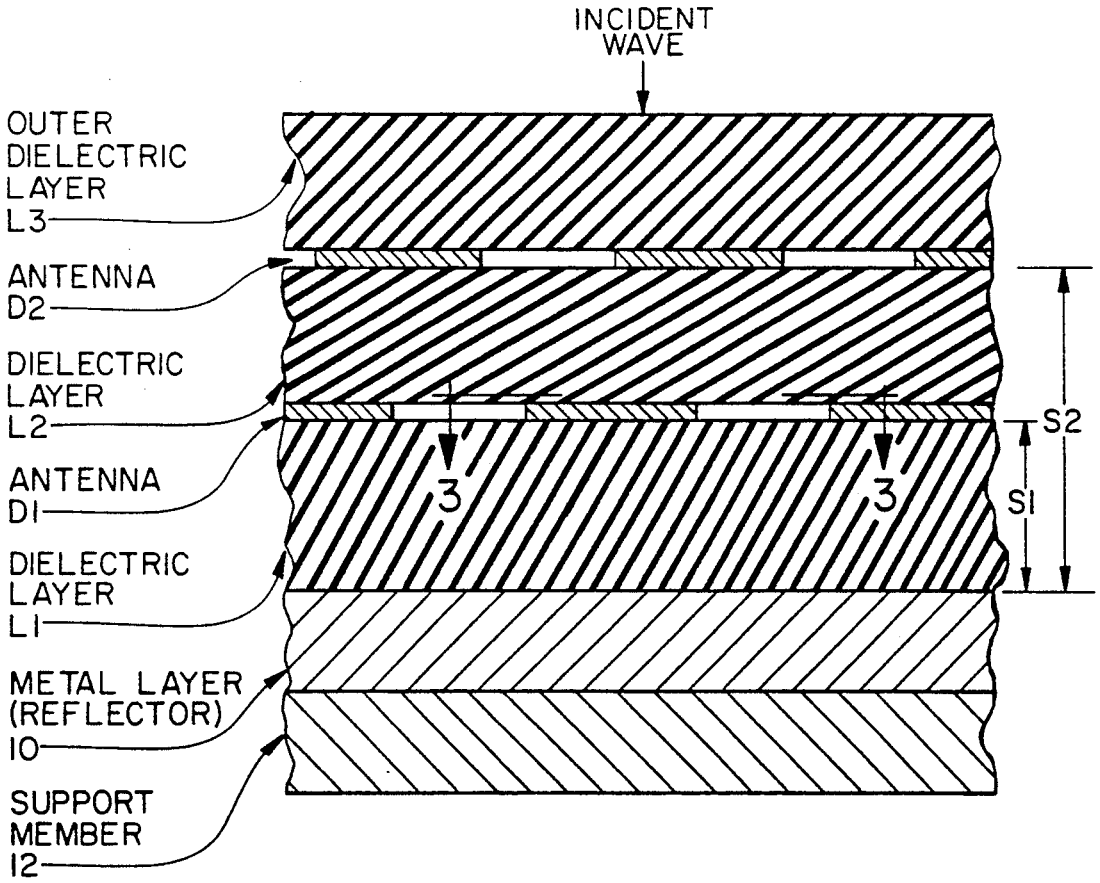
FIG. 2 is an enlarged fragmentary view of the radar absorbing apparatus of the present invention in a form employing dipole absorber elements.

Reference is now made to the fragmentary view of FIG. 2 which shows somewhat further detail of the absorber in accordance with the invention. FIG. 2 illustrates the metal sheet or plate 10 that is supported from some type of a support member illustrated generally at 12 in FIG. 2. Each of the dipoles D1 are supported on a dielectric layer L1. Similarly, each of the dipoles D2 are supported on a dielectric layer L2. There may also preferably be provided an outer dielectric layer L3.

Each of the different layers illustrated in FIG. 2 may be suitably secured to form an integral absorber apparatus adapted to be supported from the support member 12. It is noted that FIG. 2 also illustrates the spacings S1 and S2 associated with the arrays of dipoles D1 and D2, respectively. Also noted in FIG. 2 are the different sizes of dipoles D1 and D2 as referred to schematically hereinbefore in connection with FIG. 1.

It is also preferred to provide loading of the dielectric layers such as the layers L1–L3 in FIG. 2. The loading is such as to optimize both the magnetic and dielectric properties of the layers. This loading may be, for example, by means of glass spheres, carbon particles, rutile, graphite, and/or ferrites. The loading provides better overall performance particularly in terms of bandwidth and reflectivity.

The aforementioned loading may also be implemented by means of a thin layer or coating of a lossy material such as graphite or a ferrite/graphite mixture in an epoxy base. This coating provides improved overall performance, particularly in terms of bandwidth and reflectivity. The coating may be provided at any convenient place in the absorber. For example, the coating may be provided on layer L3 in FIG. 2, over the antenna pattern layer (D1 and D2), or between the antenna pattern and ground plane.

Figure 3:
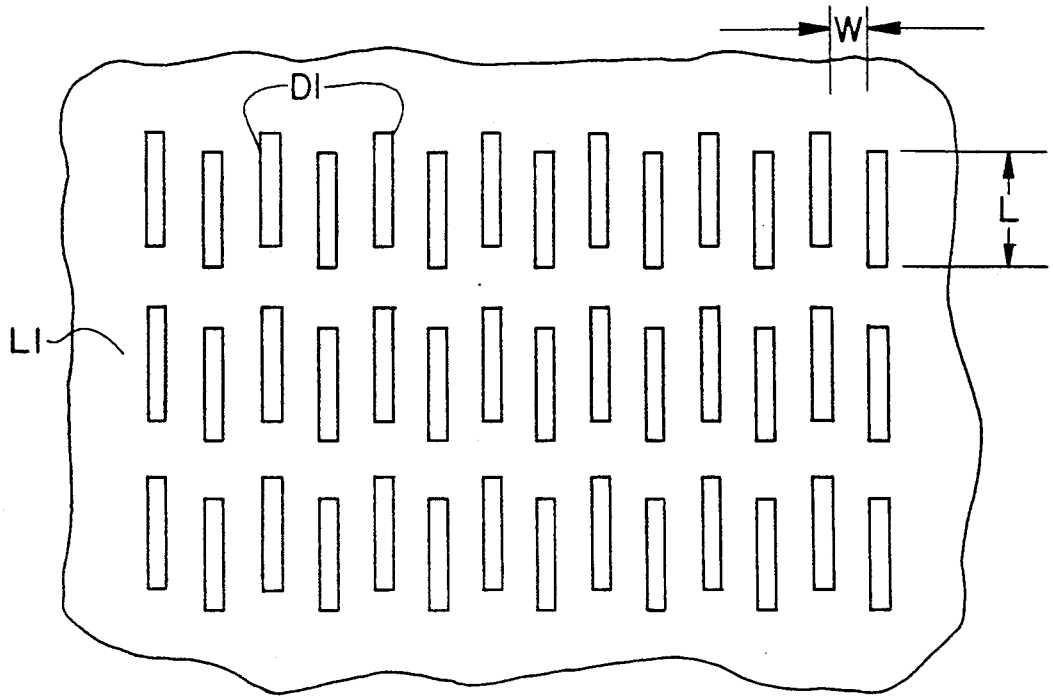
FIG. 3 is a plan view taken along line 3—3 of FIG. 2 illustrating the somewhat staggered placement of the dipole elements arranged in a two-dimensional array.

Reference is also now made to FIG. 3 that illustrates the dielectric layer L1 with associated dipoles D1. FIG. 3 clearly illustrates the manner in which the dipoles D1 are maintained in a somewhat staggered two-dimensional array. Each of the dipoles may have a length L of one-half wavelength. The spacing W between dipoles may be one-quarter wavelength. The staggering of the dipoles as illustrated in FIG. 3 minimized the detrimental effects of mutual coupling between antenna elements or dipoles.

The dielectric layers L1–L3 illustrated in FIG. 2 may be constructed of different types of dielectric materials. One particular material that has been used extensively for these dielectric layers is synthetic rubber.

Figure 4:
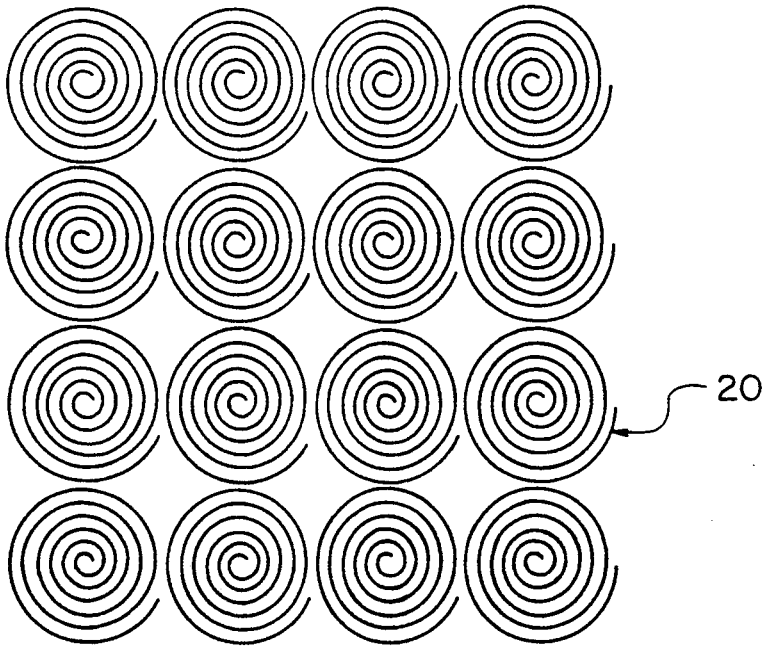
FIG. 4 is an array of elements in which each of the elements is of spiral configuration as in accordance with an alternate embodiment of the invention.

Thus, there is provided an array of dipoles of different length as the array extends away from the sheet reflector 10. The shorter dipoles D1 are nearer to the reflector 10 and the longer dipoles are further away. In FIG. 2 there are illustrated two arrays of dipoles. However, it is understood that there may be more than two separate dipole arrays. Furthermore, each of the antenna elements may be of other construction such as illustrated in FIG. 4 herein, in which the antenna element is of spiral configuration. The spaced layers of antenna elements are designed to form, log-periodic type structures in the frequency range of 2 to 18 GHz. The log-periodic structure provides improved bandwidth performance.

In accordance with one embodiment of the present invention, the shortest antenna element may have a length of 0.83 centimeters which is one-half wavelength resonance at 18 GHz. The longest element has a length of 7.5 centimeters. This corresponds to one-half wavelength resonance at 2 GHz. The antenna elements in between the aforementioned shortest and longest elements may be distributed on some type of a log-periodic basis. In FIG. 3 the dimension W is typically one-quarter wavelength as measured in the dielectric material and not in free space.

As referred to in FIG. 2, the array of dipoles D1 are on a dielectric layer L1. These dipoles may be printed on the dielectric substrate in which case they are very compact in design for a minimum of back scattering energy over a broad range of frequencies. However, in accordance with one initial embodiment of the present invention, a two foot square sample of dipoles has been fabricated on a cardboard sheet that forms the dielectric layer L1. The dipoles are fabricated from steel/nickel plated, size 20-1¼ inch dress maker's pins that are cut to be resonant at say 5 GHz and 10 GHz. One embodiment was comprised of a two-dimensional array of 1.2 inch length pins along with a smaller two dimensional array of 0.6 inch length pins. As it relates to FIG. 1, this means that the dipole D1 is 0.6 inch in length and the dipole D2 is 1.2 inch in length. The pins are spaced in-plane, one-quarter wavelength apart (0.6 inch apart for the 1.2 inch length and 0.3 inch apart for the 0.6 inch length pins). The overall reflectivity for this system of two sheets is such that resonant peaks were measured at approximately 5.74 GHz and 9.0 GHz. The reflectivities measured are −25 dB (less than one percent of the incident power being reflected).

In connection with the description to this point reference has been made to the use of two layers including dipoles D1 and D2. In order to provide broadband absorption over a full frequency range such as from 2 to 18 GHz, several different layers of different length needles or dipoles may be employed. In this regard, reference is made hereinafter to FIG. 9 which shows a reflectivity curve for one embodiment of the present invention in which two layers are employed.

Reference has been made hereinbefore to the use of dressmaker's pins or needles for forming the dipoles D1 and D2. This technique has been used in some of the early testing of the concepts of the invention, but in accordance with the invention, it is preferred to form the dipoles as conductive layers employing silk screen and transfer methods. This is particularly advantageous because then one can easily control the resistive loading of the antenna element by using resistively loaded inks. Resistive loading has been used with different inks with different degrees of resistive loading such as 0.04, 0.25, 0.52, and 1.5 ohms/square. In one experiment, the optimum bandwidth for a single layer of 0.060 inch wide dipoles printed on a dielectric layer and spaced to 0.30 inch apart (0.6 inch length dipole strip resonant at 10 GHz) occurs when the ink is about 0.25 ohms/square.

Reference has been made hereinbefore to the use of dipoles at the antenna elements of the array. However, an even more preferred arrangement may be the spiral configuration of absorber elements as indicated at 20 in FIG. 4. Once again, different size spiral absorber elements may be employed to provide the broadband concepts as illustrated in FIG. 1 herein. The spiral configuration is particularly desired because it is polarization insensitive which is a desired characteristic of the absorber. This configuration is also intrinsically broad band due to its frequency independent properties.

Figure 5A:
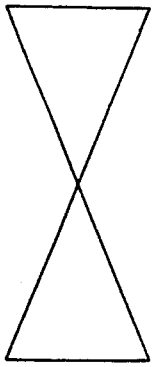
FIGS. 5A–5D illustrate other forms of elements that may be employed in accordance with the principles of the present invention.
Figure 5B:
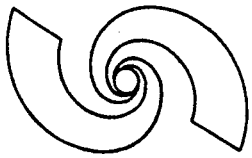
Figure 5C:
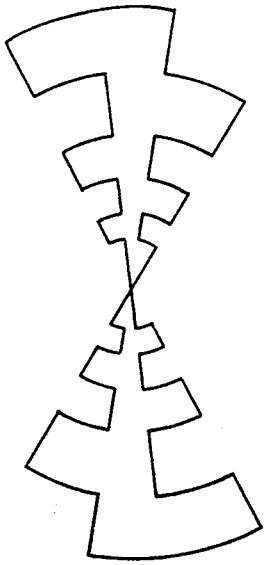
Figure 5D:
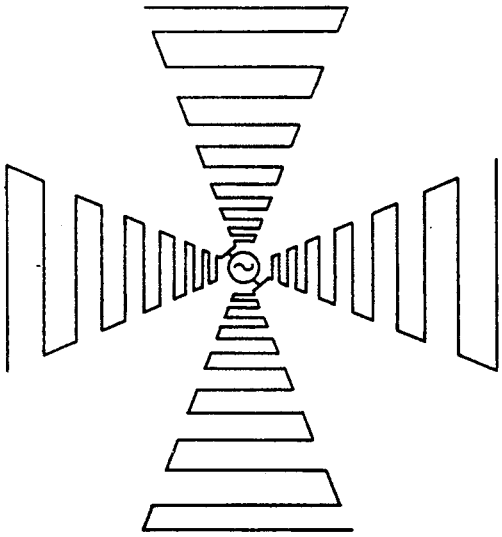

Other forms of absorber elements are described in FIGS. 5A–5D. FIG. 5A illustrates a bi-conical absorber element. FIG. 5B illustrates a spiral-type absorber element. FIG. 5C illustrates a logarithmically periodic absorber element. FIG. 5D illustrates a circularly polarized logarithmically periodic absorber element. The absorber element of FIG. 5D belongs to a class of frequency independent absorbers. Frequency independent absorbers may be broadly characterized as either log periodic absorber elements or spiral absorber elements. Both of these have the characteristic of being frequency independent so as to provide polarization insensitivity.

Reference has been made hereinbefore to the concepts of resistively loading the absorber elements. In this regard, reference has been made to FIG. 7 that illustrates that with the proper amount of resistive loading, proper absorption occurs, not just at a one-half wavelength spacing, but at a preferred smaller spacing on the order of less than one-tenth wavelength. It has been mentioned previously that the resistive loading can be carried out by means of silk screen deposition of resistive inks. In this case the feed gap of the absorber may be open-circuited or short-circuited. The resistive loading can also be carried out by means of providing a resistor between the terminals of the absorber, (highly conductive), such as the resistor 22 associated with the spiral absorber element 24 illustrated in FIG. 6. The resistor 22 interconnects the two innermost terminals of the spiral 24. In an array of spirals, there are thus resistors 22 associated with each of the individual spiral elements.

There has been described herein the use of resistors such as the resistor 22 in FIG. 6 for providing resistive loading. In place of a resistor or in conjunction therewith one may also employ a reactive impedance such as an inductance or capacitance.

Figure 8:
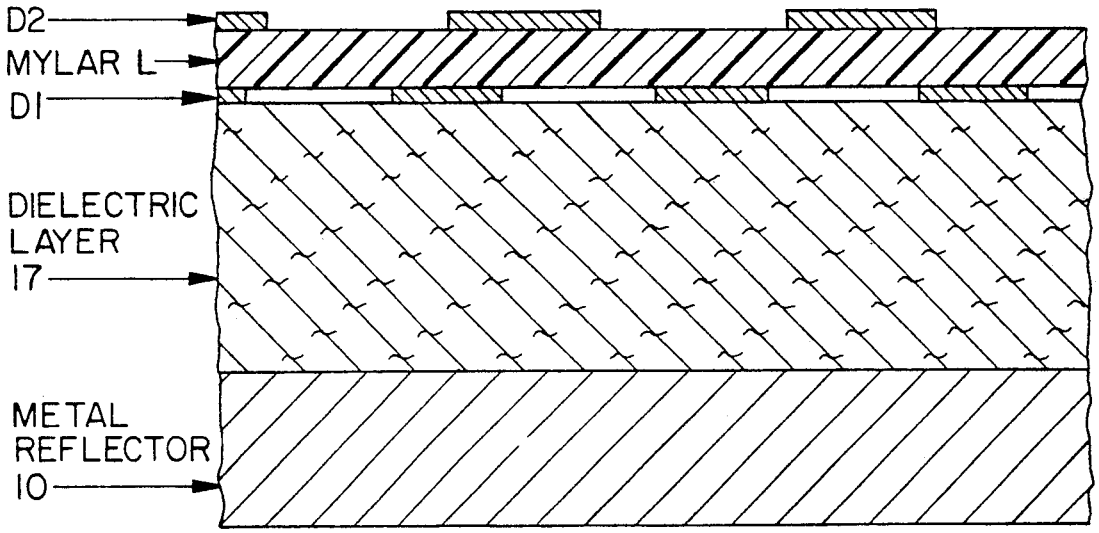
FIG. 8 illustrates an alternate form of absorber.
Figure 9:
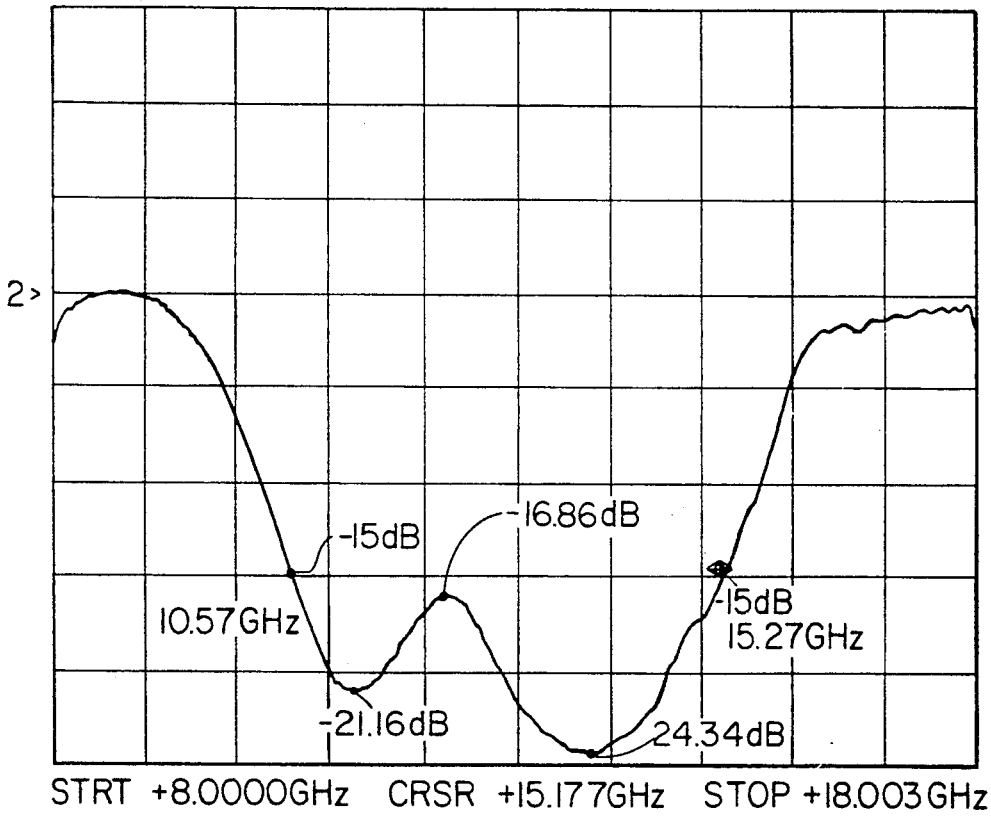
FIG. 9 is a diagram in the form of a frequency response showing a reflectivity curve in particular for a multiple layer absorber such as illustrated in FIG. 8.

Reference is now made to FIG. 8 and the associated reflectivity curve of FIG. 9. In FIG. 8 there is shown the metal reflector 10 and a single mylar strip or layer L for supporting on either side thereof, absorber elements in the form of dipoles D1 and D2, respectively. Each of these dipoles maybe formed by depositing by silk screening and transfer methods a resistive ink that will form each of the individual dipoles. The resistive ink automatically provides the desired resistive loading. FIG. 8 also shows the intermediate layer at 17 which may be a cardboard or other dielectric layer or may even be air. In this particular embodiment, the thickness of the layer 17 is 0.180 inch and the thickness of the mylar is 0.030 inch. The layer comprised of dipoles D1 is designed for resonance 11.52 GHz. The layer comprised of dipoles D2 is designed for resonance at 13.8 GHz. FIG. 9 shows the resultant reflectivity curve in which it is noted that resonant peaks occur at approximately 11.52 GHz and 13.8 GHz. The −15 dB bandwidth extends from approximately 10.57 GHz to 15.27 GHz. As other layers of absorber elements are added, each at a different resonance, and thus each of a different size, then the bandwidth expands. With the proper number of layers, the full bandwidth can be covered such as from 2 to 18 GHz.

Figure 12:
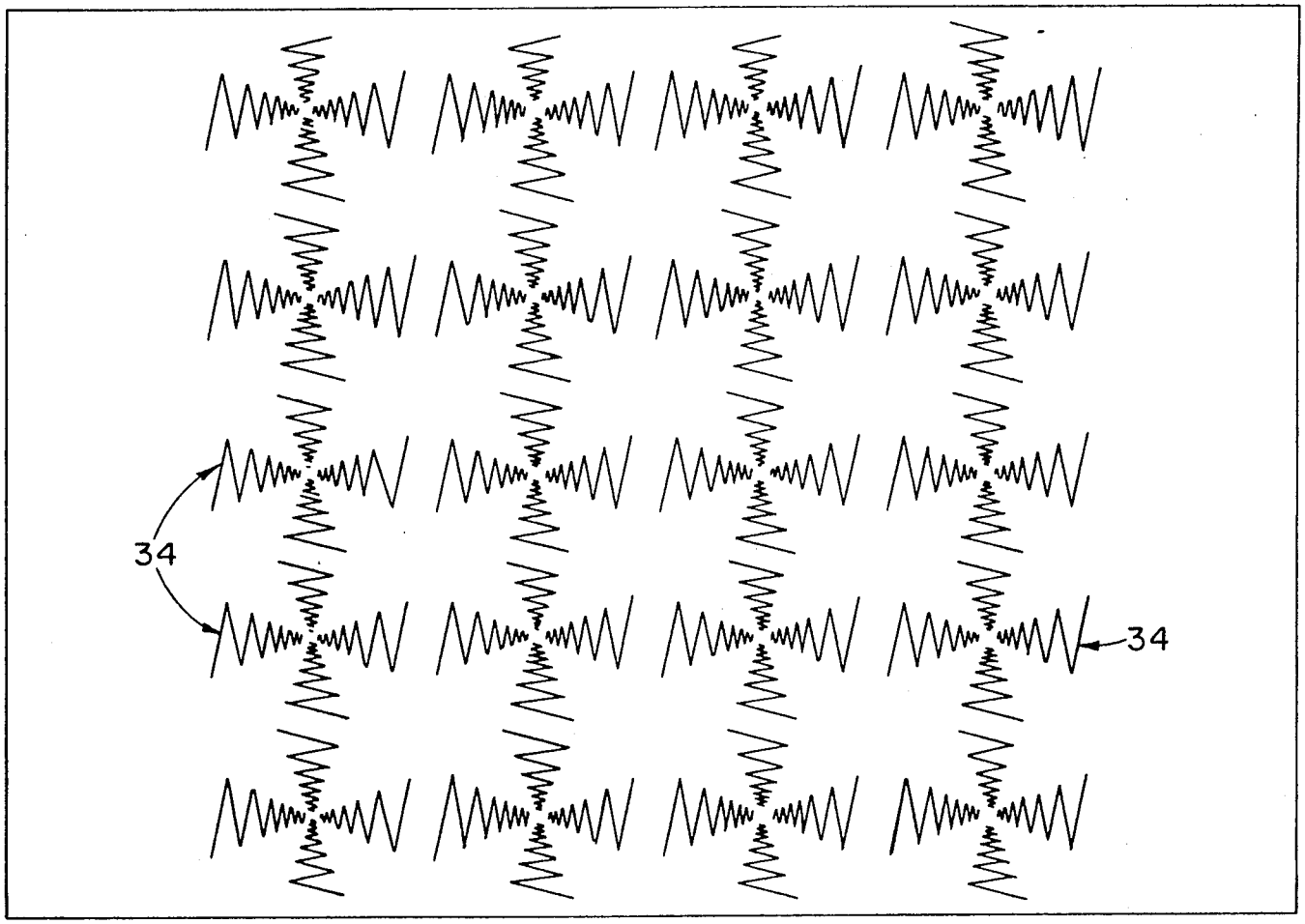
FIG. 12 illustrates a regular zig-zag absorber array pattern.
Figure 13:
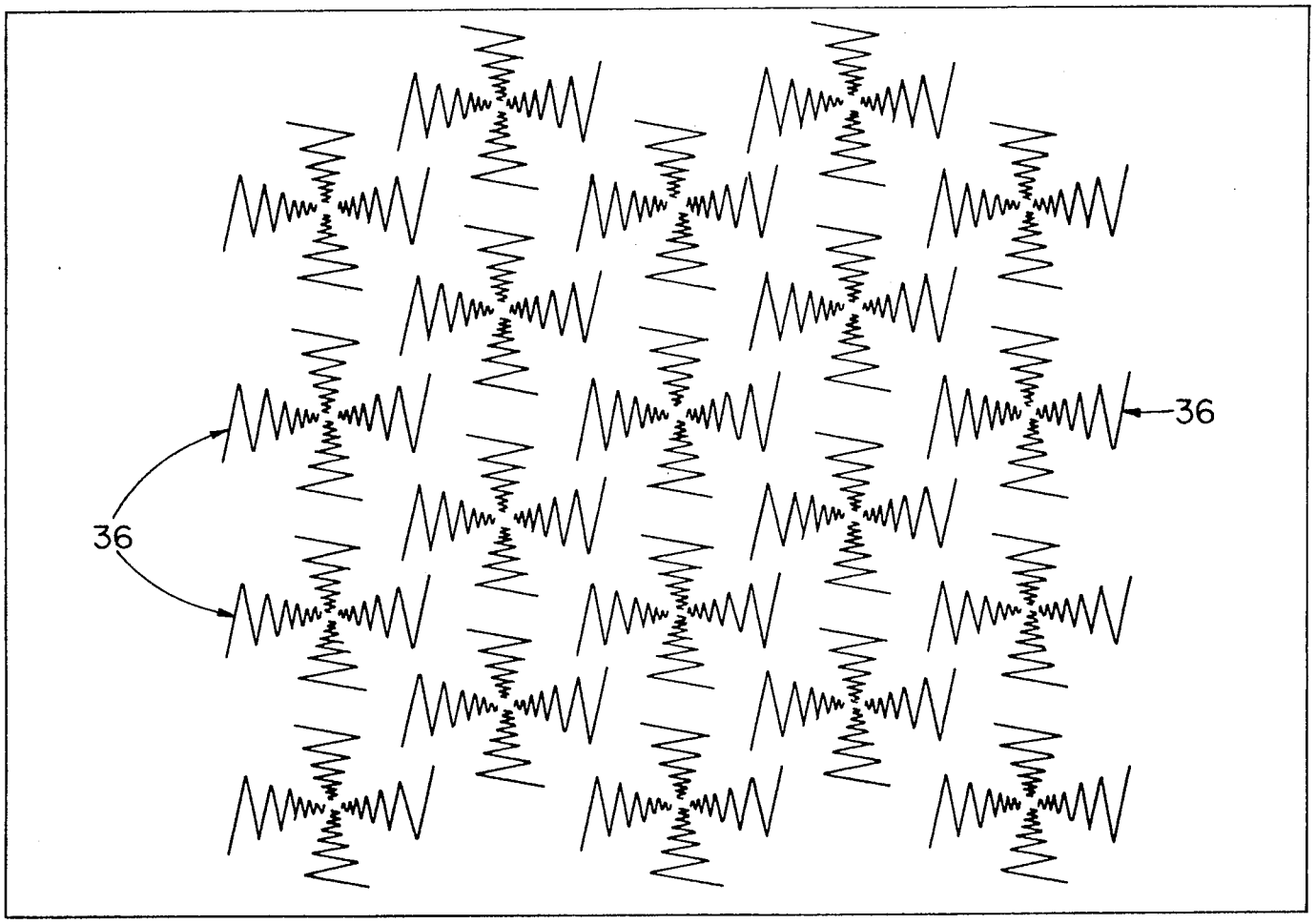
FIG. 13 illustrates a staggered zig-zag absorber array pattern.
Figure 14:
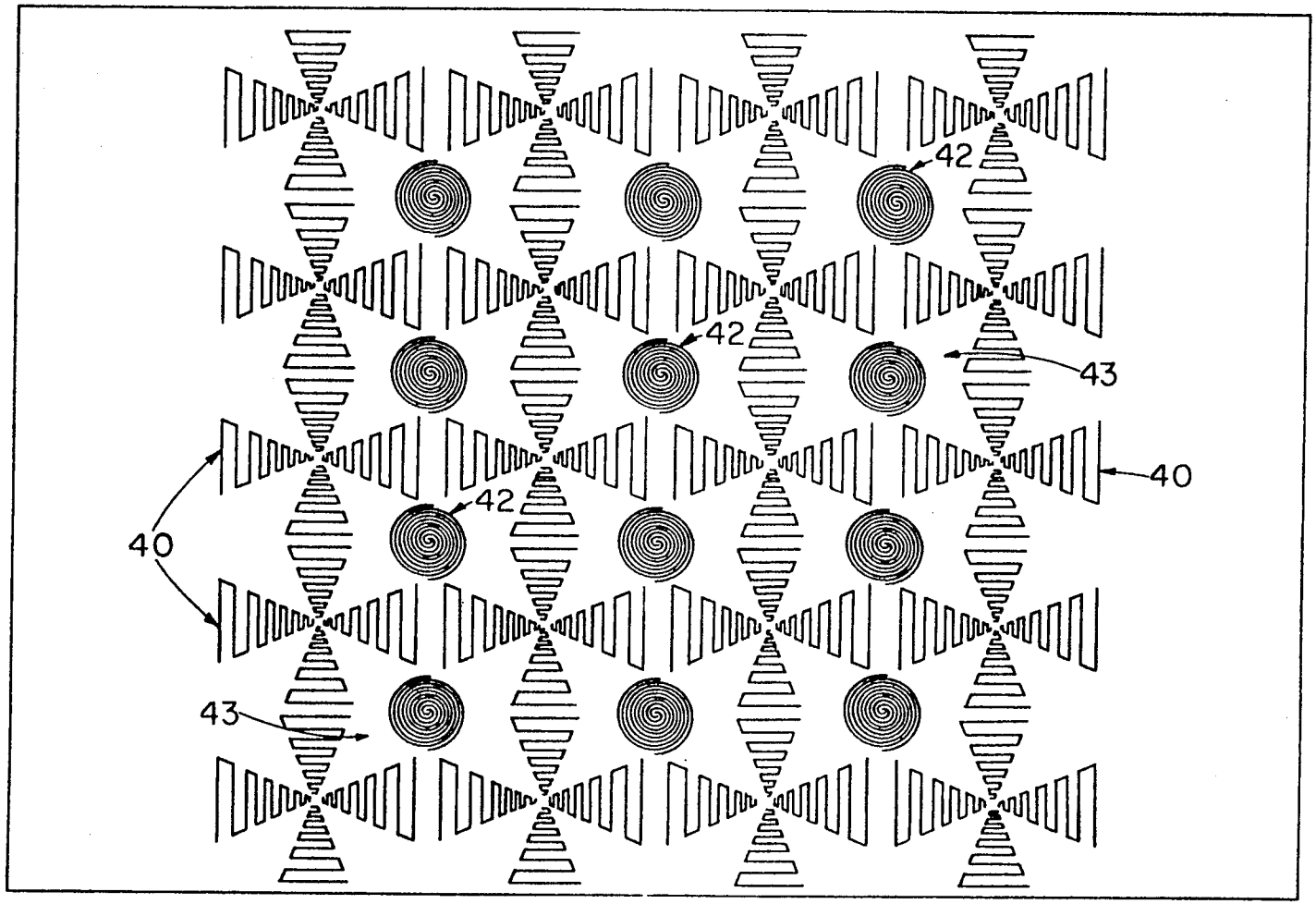
FIG. 14 illustrates an array pattern comprised of trapezoidal elements and spiral elements.
Figure 15:
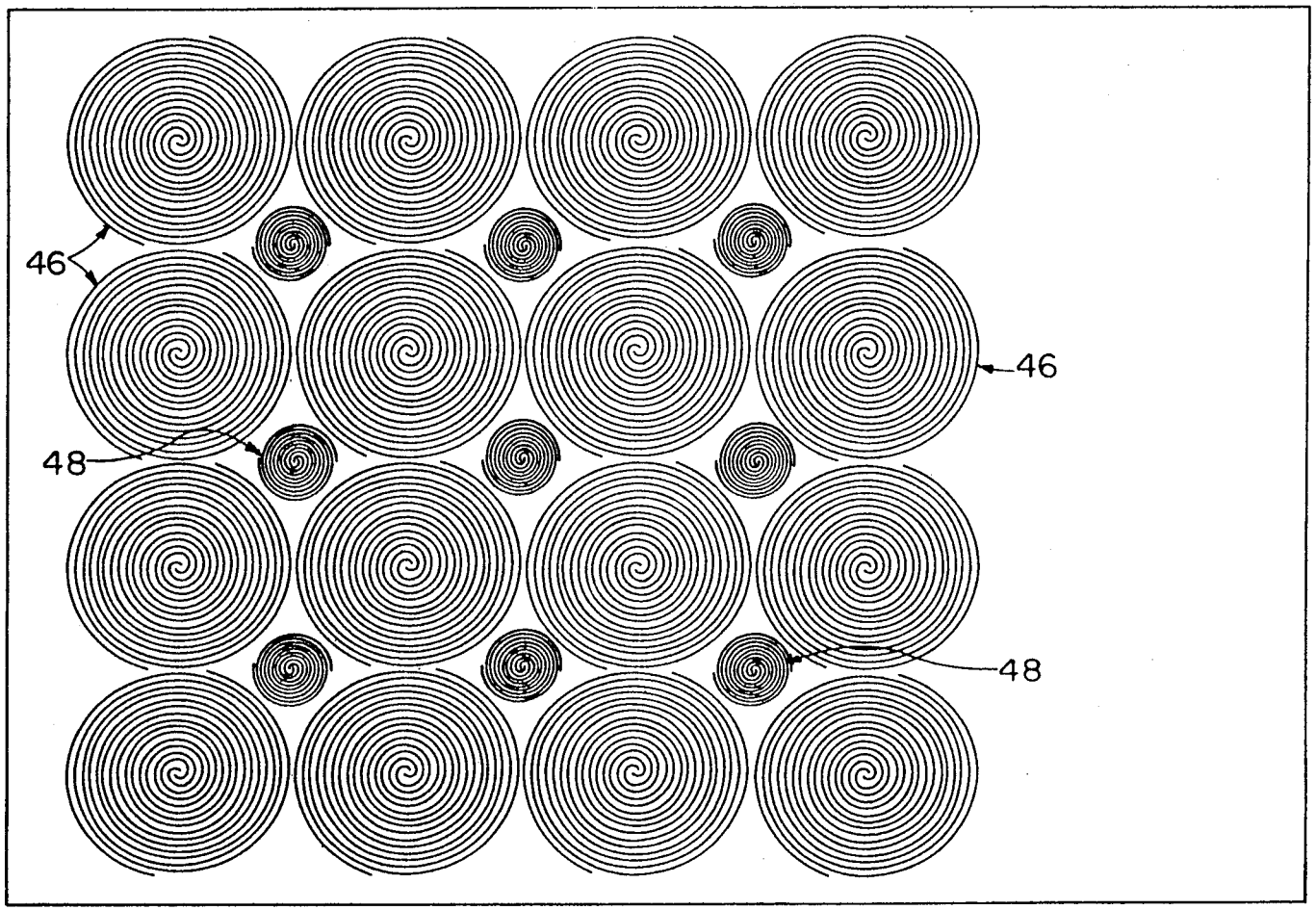
FIG. 15 illustrates an array pattern comprised of large and small spiral elements.
Figure 16:
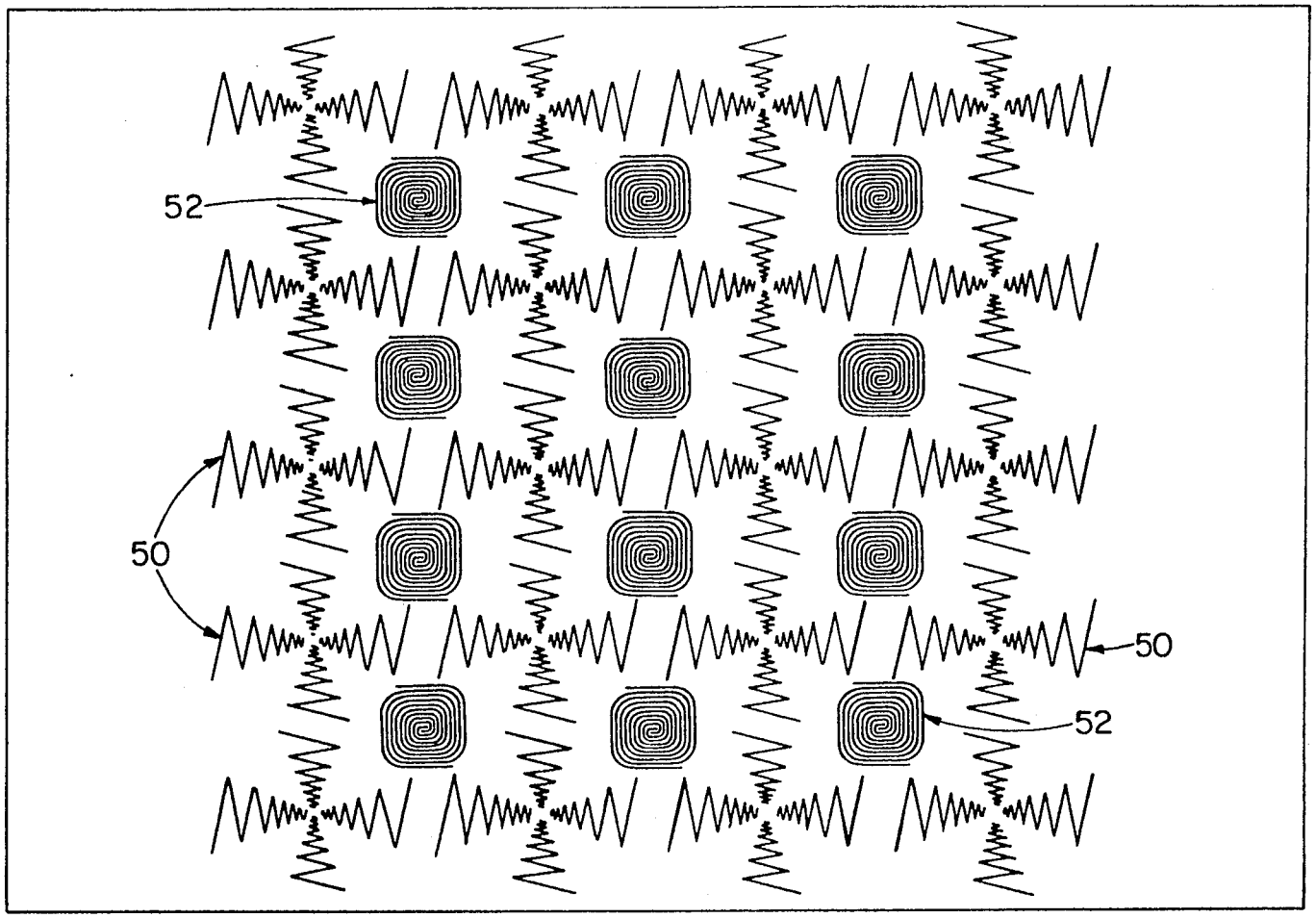
FIG. 16 illustrates an array pattern comprising zig-zag elements and square-shaped spiral elements.

Reference is now made to FIGS. 10–16 for an illustration of other embodiments of absorber array patterns. FIGS. 10–13 illustrate patterns employing a single type of absorber construction. FIGS. 14–16 illustrate the concepts of the present invention in which broadbanding may be carried out in a single layer by virtue of employing different size and/or different configuration absorber elements in a single planar array.

Figure 10:
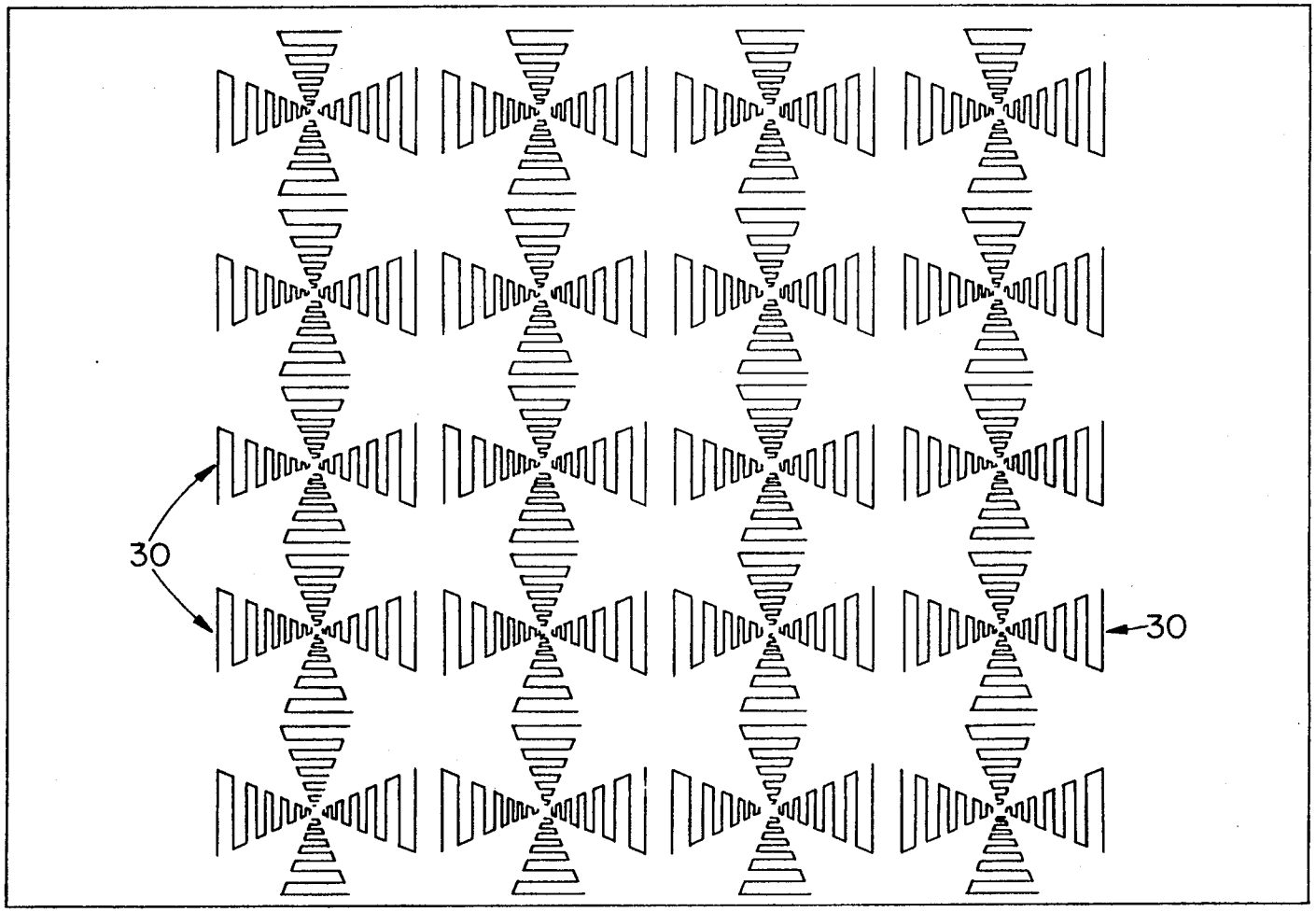
FIG. 10 illustrates a regular trapezoid absorber array pattern.
Figure 11:
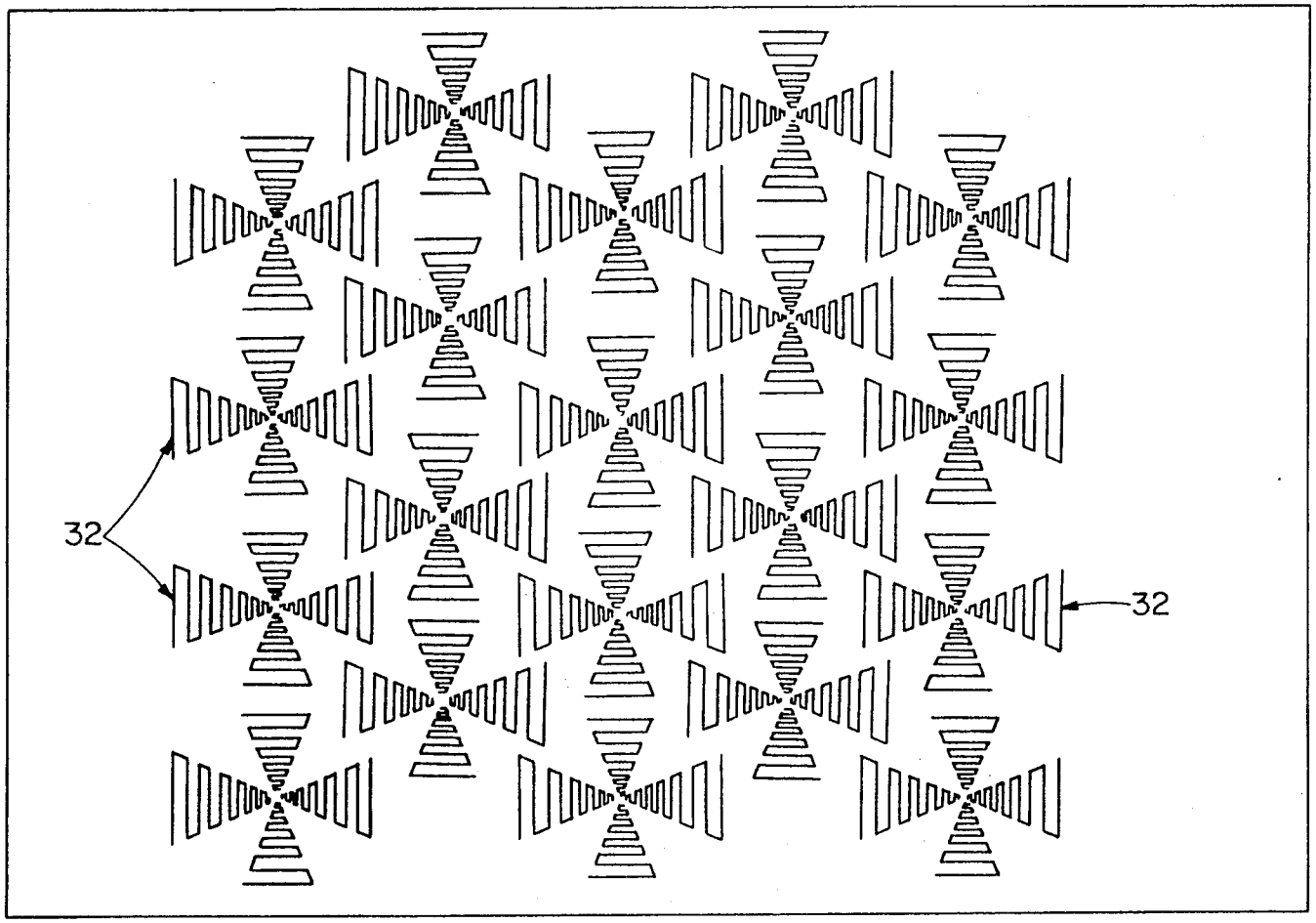
FIG. 11 illustrates an offset trapezoid absorber array pattern.

The absorber array pattern of FIG. 10 is comprised of trapezoidal absorber elements 30 disposed in a regular array. Although this form of an array is effective in providing good signal absorption, improved coverage is obtained by a configuration as illustrated in FIG. 11. FIG. 11 illustrates absorber elements 32 that are also trapezoidal elements, but that are in a staggered or offset configuration. This provides for a greater number of elements per given area.

FIG. 12 shows a zig-zag absorber array comprised of a plurality of zig-zag absorber elements 34. These elements 34 are disposed in a regular array. Again, to provide greater coverage of elements per area, a staggered array may be provided such as illustrated in FIG. 13 shows a plurality of zig-zag absorber elements 36 disposed in a staggered or offset manner.

FIG. 14 also depicts a regular array of trapezoidal absorber elements 40. The trapezoidal absorber elements are interspersed by a further array of spiral absorber elements 42. The spiral absorber elements 42 are interspersed in the open area 43 defined between four of the trapezoidal absorber elements 40.

In FIG. 14 it is noted that the spiral absorber elements 42 are relatively small in configuration. This means that for a given spacing of the absorber array from the reflector, the spiral elements will be tuned to a different frequency than the other absorber elements 40. There is thus provided tuning at different frequencies in a single layer. This provides bandwidth enhancement in a single layer configuration. Of course, the embodiments described hereinbefore in connection with multi-layering for broadband enhancement may also be employed in association with the single layer enhancement. For example, the configurations as illustrated in FIG. 14 may be provided in different layers with each layer having the absorber elements of different size. This will provide still further bandwidth enhancement.

Reference is now made to FIG. 15 which is still a further embodiment of the present invention employing broadband enhancement in a single layer. The configuration of FIG. 15 includes interspersed spiral absorber patterns including a large pattern comprised of spiral absorber elements 46 and a small pattern comprised of small spiral absorber elements 48. Again, each of the different spirals are essentially tuned to a different frequency and provide some degree of absorption at these different frequencies. Thus, a configuration such as illustrated in FIG. 15 might provide the type of frequency response as illustrated previously in connection with FIG. 9. Again, however, this is provided in a single layer rather than multiple layers, although, the concepts illustrated in FIG. 14 may also be expanded to multiple layers to provide further broadband enhancement.

FIG. 16 illustrates a regular array of zig-zag absorber elements 50 and associated square-shaped spiral absorber elements 52. The configuration of FIG. 16 provides results similar to that provided in configurations of FIG. 14 and 15.

The particular configuration of FIG. 15 is one of the preferred configurations in that the two separate arrays (elements 46 and 48, respectively) can be made quite compact. Also, the spiral absorber element is, in particular, polarization insensitive which is also a further advantage.

Figure 17:
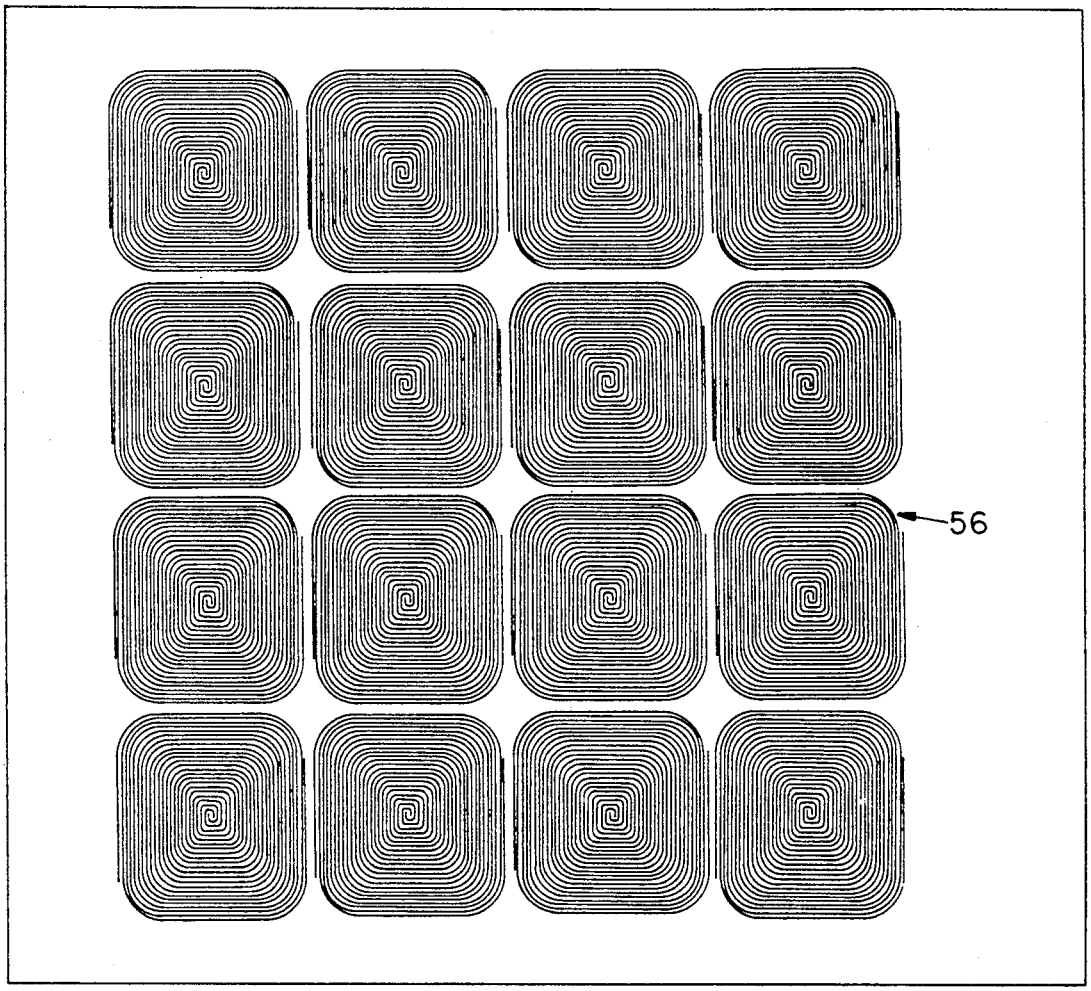
FIG. 17 illustrates a pattern comprising only square-shaped spiral elements.

FIG. 17 illustrates an array of absorber elements that are in the form of square spirals as illustrated at 56. These elements are also frequency independent absorber structures.

Figure 18:
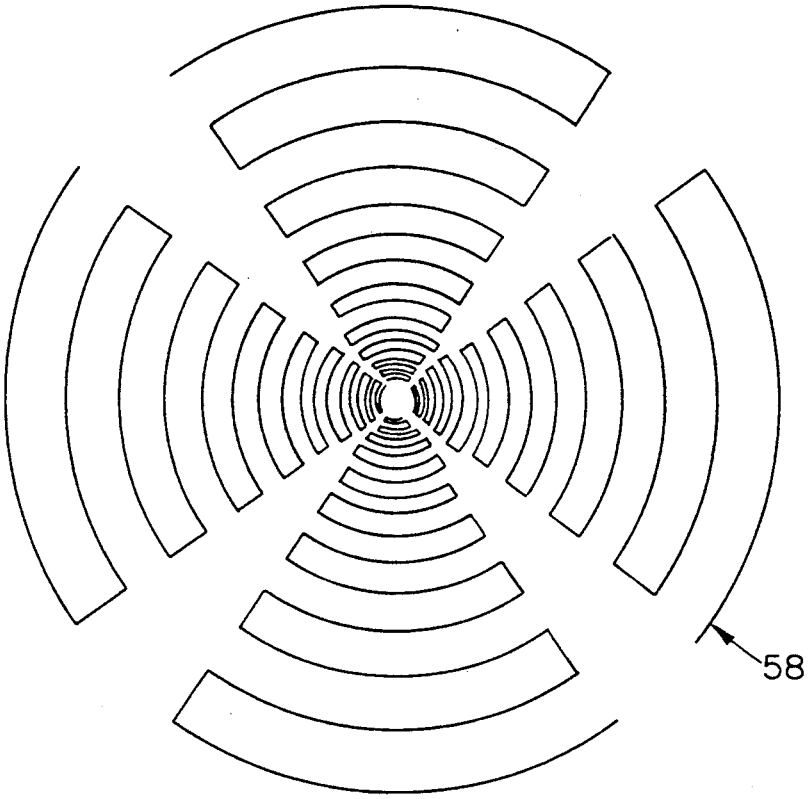
FIG. 18 illustrates an array element comprising circular tooth log-periodic structure.

FIG. 18 illustrates at 58 a still different version of an absorber element. This version is in the form of a circular tooth log-periodic element.

Figure 19:
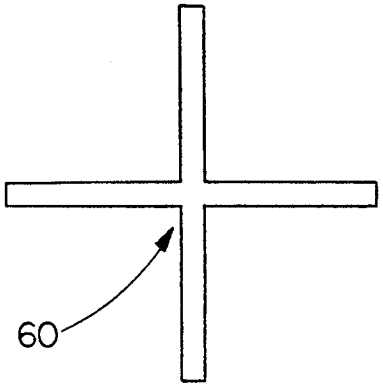
FIG. 19 illustrates a crossed dipole pattern for the element.
Figure 20:
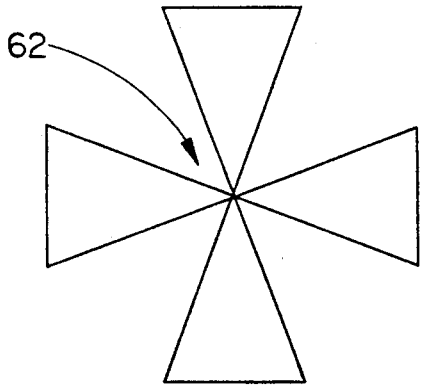
FIG. 20 illustrates a crossed bicone for the element.

FIGS. 19 and 20 show further versions of the present invention. In FIG. 19 there is shown a crossed dipole absorber element 60 and in FIG. 20 there is shown a crossed bicone absorber element 62. Both of these elements provide circular polarization performance.

Although the concepts of the present invention have been described as used in a thin, flexible dielectric system, these concepts may also be employed in a rigid system. For example, these concepts may be employed in high temperature applications of several hundred degrees celsius or higher. Such materials comprising the dielectric portion of the system include ceramic materials such as cobalt oxide, vanadium dioxide or rhenium trioxide, or ceramic composite materials such as silica fiber reinforce ceramic composites, or boro-silicate glass reinforced with silicon carbide fibers (ceramic matrix). In these high temperature applications the absorber patterns are also formed by high temperature resistant inks. Also, any bonding agents have to be compatible with high temperature applications. The ceramic layers may be doped to control electrical properties.

Figure 21:
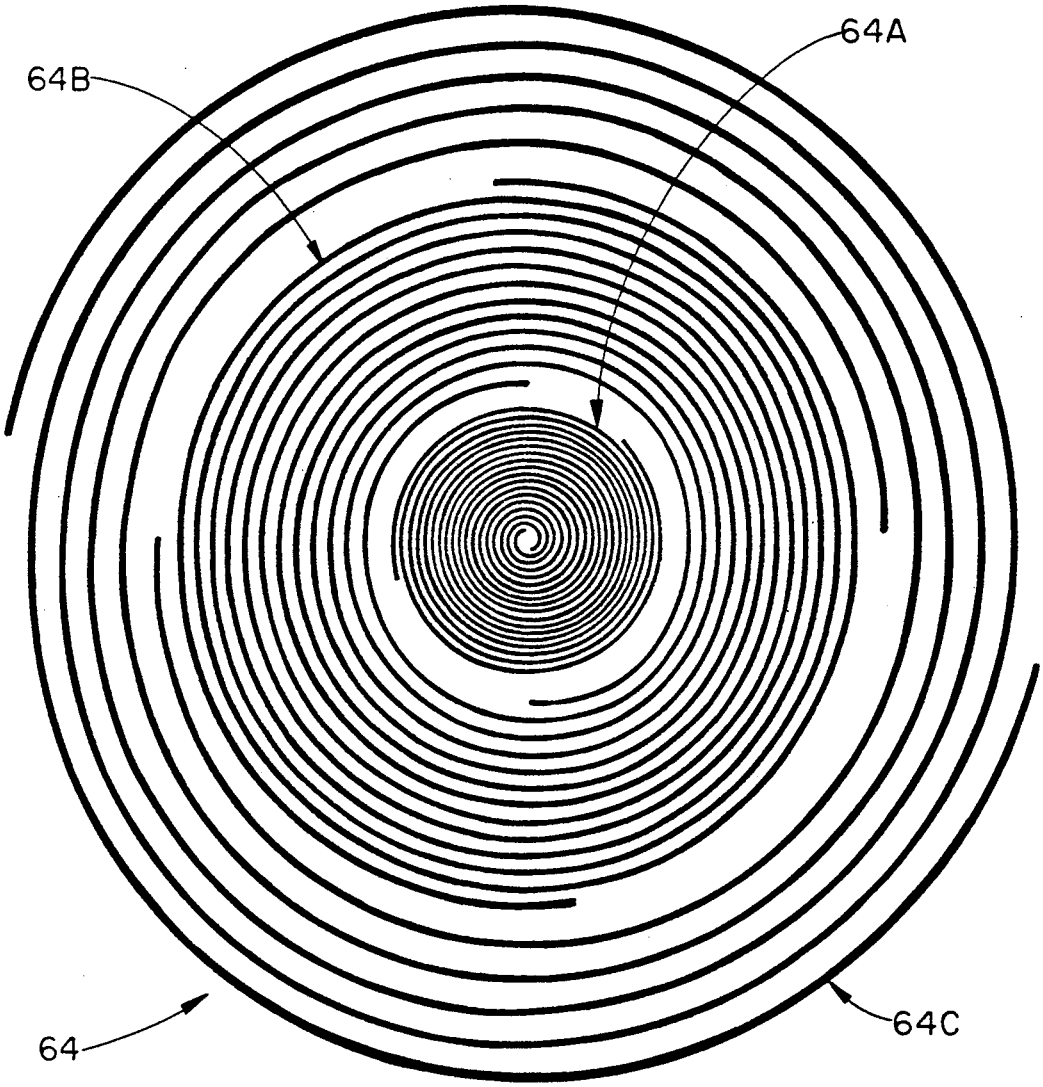
FIG. 21 illustrates an alternate spiral configuration for the pattern employing three separate spirals of varying spiral turn spacing.

Reference is now made to FIGS. 21–27 for additional absorber patterns that have been found to, in particular, provide substantial improvement in broadband operation. More particularly, FIG. 21 describes a spiral absorber pattern 64 that is comprised of three separate spirals 64A, 64B, and 64C. It is noted that each of the spirals are separate and not interconnected. Furthermore, each of the spirals are of different turn spacing. The spiral 64A is most tightly wound, the spiral 64B is less tightly wound while the other spiral 64C is the most loosely coupled with the widest spacing between turns. Each of the different spirals are essentially tuned to a different frequency and thus provide some degree of absorption at these different frequencies. This thus allows for broadbanding in a single absorber array layer. FIG. 21 shows only a single pattern, however, there would be several of these spiral configurations in the overall absorber construction. The spirals may be, for example, in an array as the one previously illustrated in FIG. 15.

Figure 22:
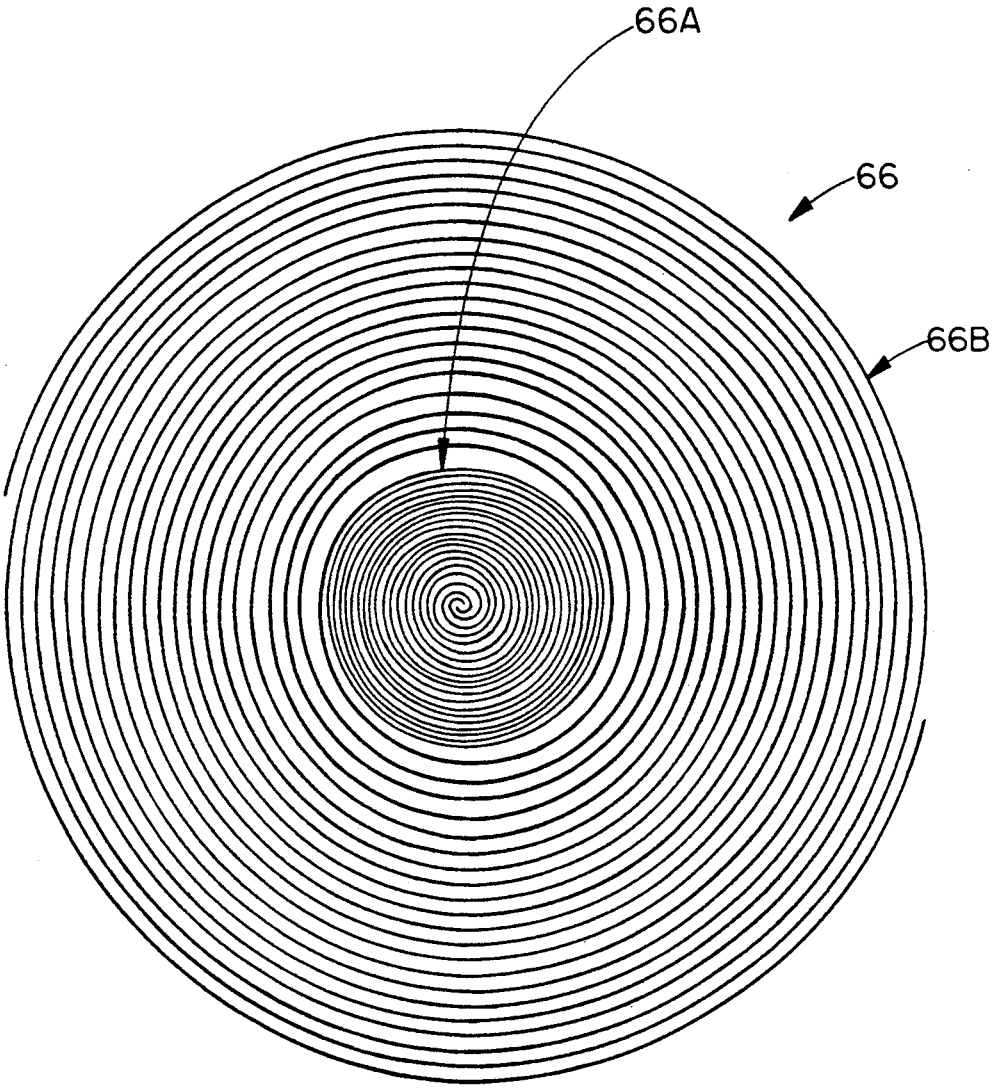
FIG. 22 illustrates a further spiral antenna pattern showing two different spacing spirals continuously connected.

Reference is now made to FIG. 22 for a further spiral absorber pattern. This particular spiral absorber pattern is comprised of two separate spiral segments, including a smaller more tightly wound spiral 66A at the center and a more loosely wound outer spiral 66B disposed thereabout. It is noted in this particular embodiment that the spirals 66A and 66B are interconnected so that the spiral turns are continuous from one spiral to the other. The spiral absorber pattern of FIG. 22 also provides improved broadband operation.

Figure 23:
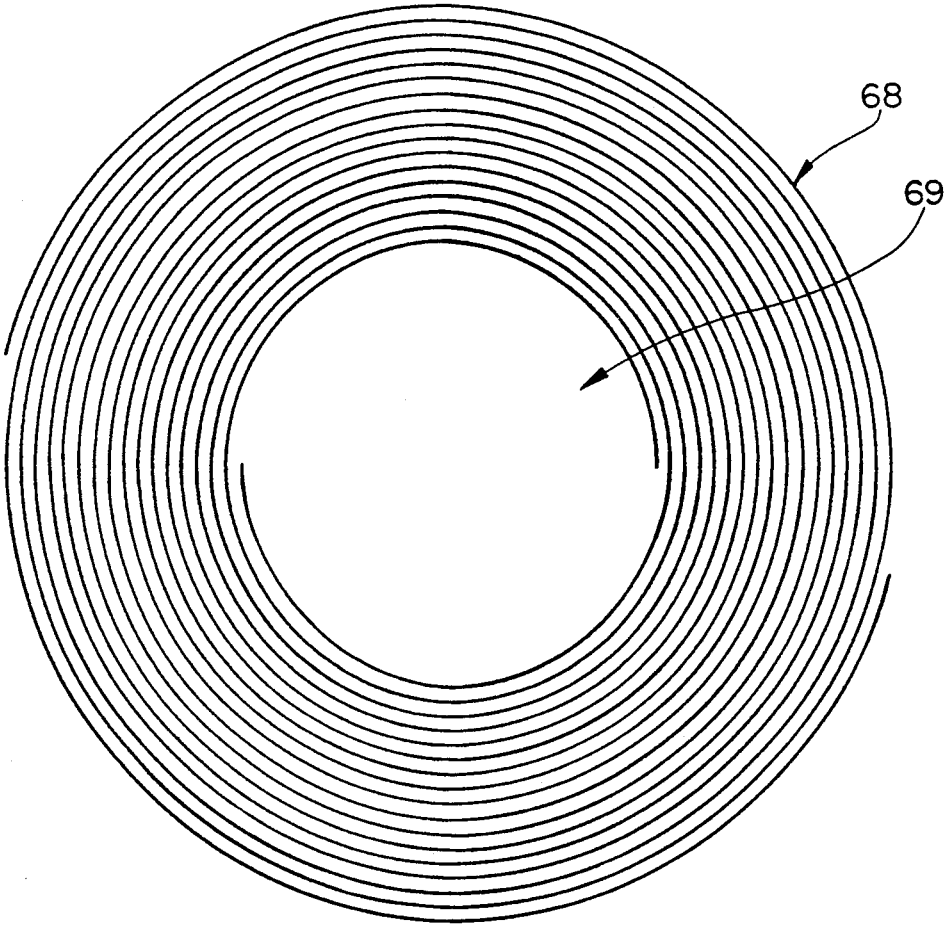
FIG. 23 illustrates a further spiral pattern having an open center area.

FIG. 23 shows a further spiral absorber pattern similar to that described hereinbefore in FIG. 4. FIG. 23 shows the spiral absorber 68. However, in the embodiment of FIG. 23 the spiral is provided with an open hole or void area as illustrated at 69 in FIG. 23.

In connection with all of the spiral absorber patterns of FIGS. 21–23, these patterns are formed by, for example, a silk screening technique. The overall material thickness is made small by printing the absorber patterns, preferably using either a resistive ink in which the loading is substantially uniform throughout the pattern or a highly conductive ink in combination with a discrete resistive load.

Figure 24:
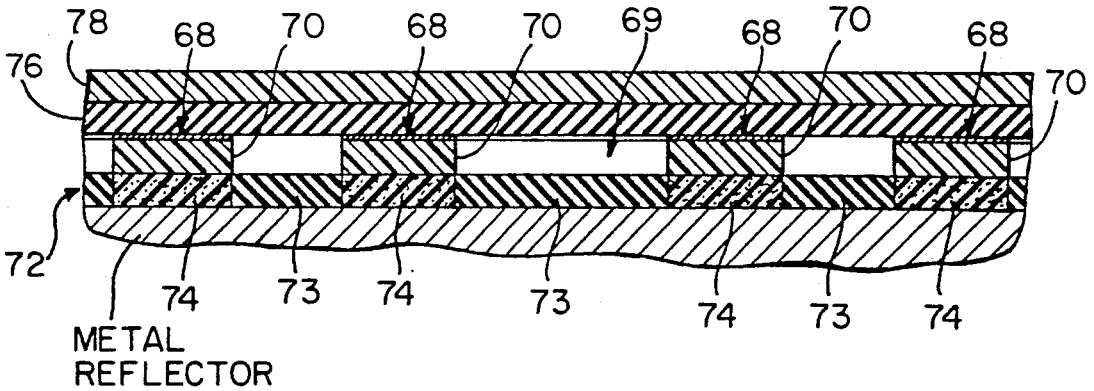
FIG. 24 is a cross-sectional view through an entire absorber construction employing the spiral pattern of FIG. 23 and illustrating the additional layers of the absorber.

Now, refer to FIG. 24 for an illustration of a fragmentary cross-sectional view of an absorber employing the spiral absorber pattern of FIG. 23. Thus, in FIG. 24 there is shown the spiral absorber pattern 68 as well as a hole or void space 69. The absorber pattern 68 is disposed on a mylar layer 70. Holes are provided in this layer in the central portion of the spiral as indicated at 69 in FIG. 24. The layer 70 is disposed over a substrate layer 72 that is actually formed of different substrate sections including a main silicone layer 73 and annular sections 74.

The particular absorber construction as shown in the cross-sectional view of FIG. 24 is characterized by the provision for the layer section 74 being of a relatively high dielectric constant. A material that has been used is a silicone rubber loaded with titanium dioxide. Titanium dioxide has a very high dielectric constant. It is noted that the section 74 underlies the absorber pattern 68. This arrangement provides for a tuning of the structure, particularly to tune the band to lower frequency. Thus, by controlling the loading of the substrate underlying the antenna pattern one can therefore tune the particular frequency band to a desired band of operation.

In FIG. 24 disposed over the mylar layer 70 is a rubber layer 76 and over the layer 76 there is provided a layer 78 that may be comprised of a thin plastic layer coated with a resistive coating. The resistive coating layer 78 may have a coating of 3100 ohms per square.

Figure 25:
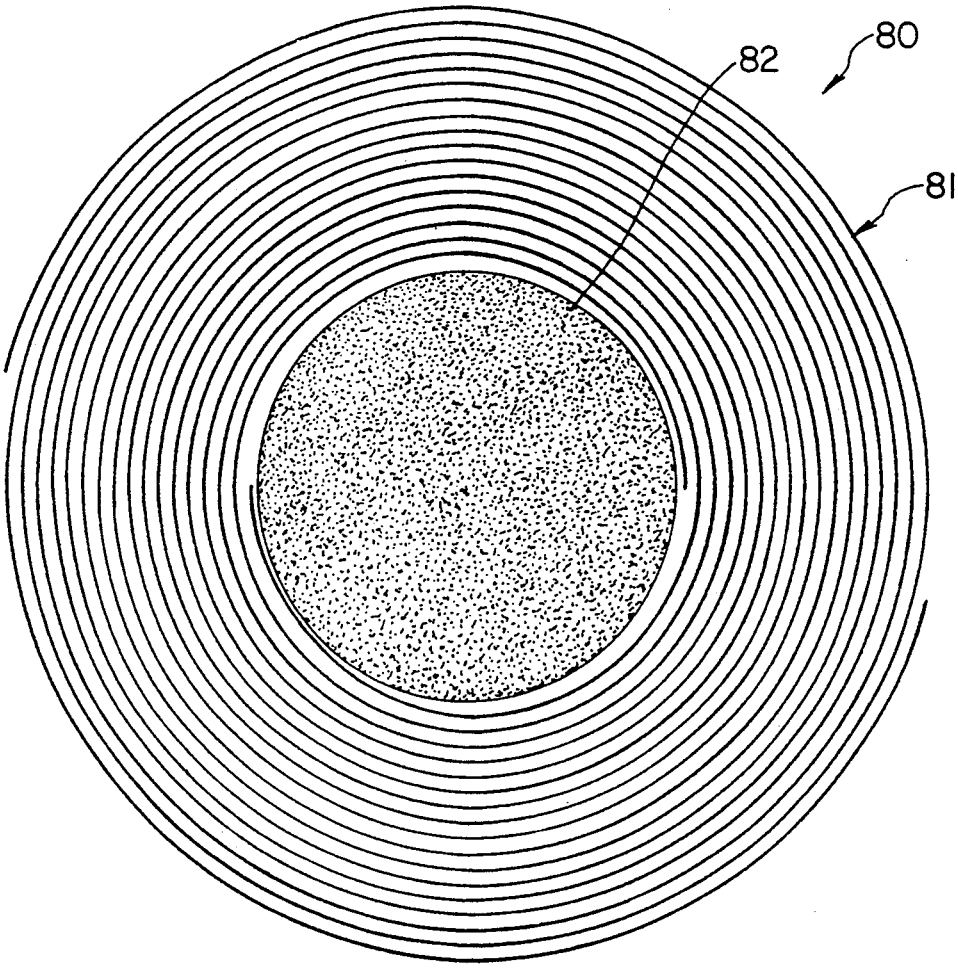
FIG. 25 illustrates a further embodiment of a spiral pattern employing a centrally disposed ferrite disk.
Figure 26:
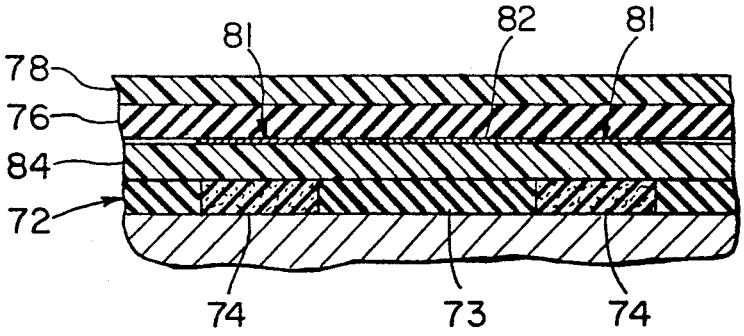
FIG. 26 is a fragmentary cross-sectional view of a complete absorber construction employing the particular spiral pattern and ferrite disk of FIG. 25.

Reference is now made to FIGS. 25 and 26 for still a further embodiment of the spiral absorber pattern. In this particular configuration of absorber pattern, there is provided a pattern 81 that has an open center area filled with a ferrite disk 82. As in the embodiment illustrated in detail in FIG. 24, this embodiment of absorber employs a mylar layer 84 for support of the absorber pattern 81 as well as the deposited ferrite disk 82. The other parts of the absorber may be the same as described in FIG. 24 and thus in FIG. 26 have been identified by the same reference characters. The absorber is thus comprised of a substrate layer 72 comprised of silicone rubber and titanium dioxide loaded silicone rubber. Overlying the absorber pattern are the aforementioned layers 76 and 78.

Figure 27:
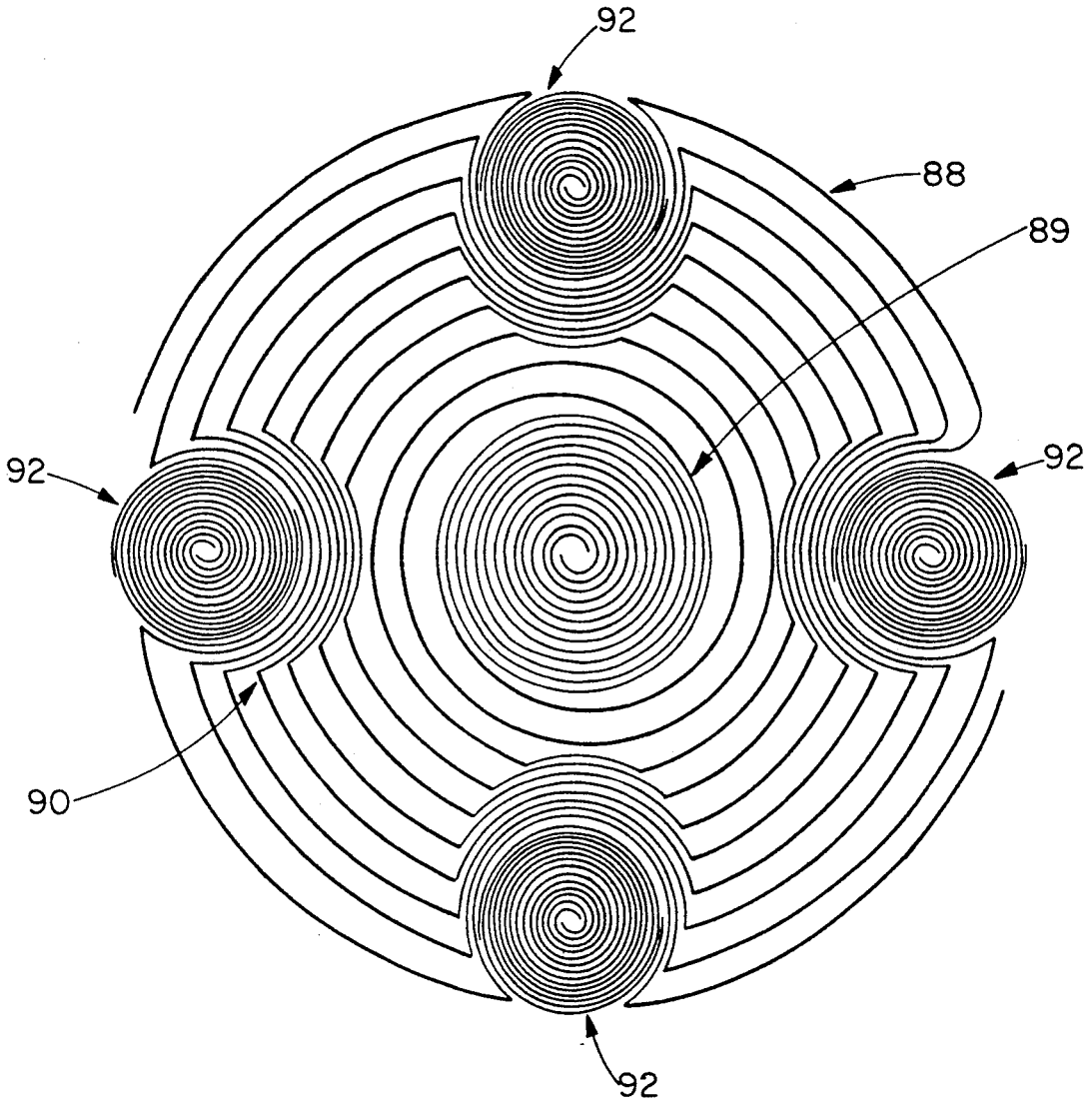
FIG. 27 shows still a further spiral pattern configuration employing both continuous and separate spiral segments.

FIG. 27 shows still a further spiral absorber pattern configuration. In FIG. 27 there is provided a main spiral 88 that is contiguous with an internal smaller diameter spiral 89. At 90° intervals of the spiral 88, the turns are directed inwardly at successive loops as illustrated at 90 in FIG. 27. Within each of these loops there is provided a separate relatively closed turn spiral 92. In the particular embodiment described herein there are four of these smaller spirals 92. This configuration of spiral absorber pattern has also been found to provide improved broadband operation.

Figure 28:
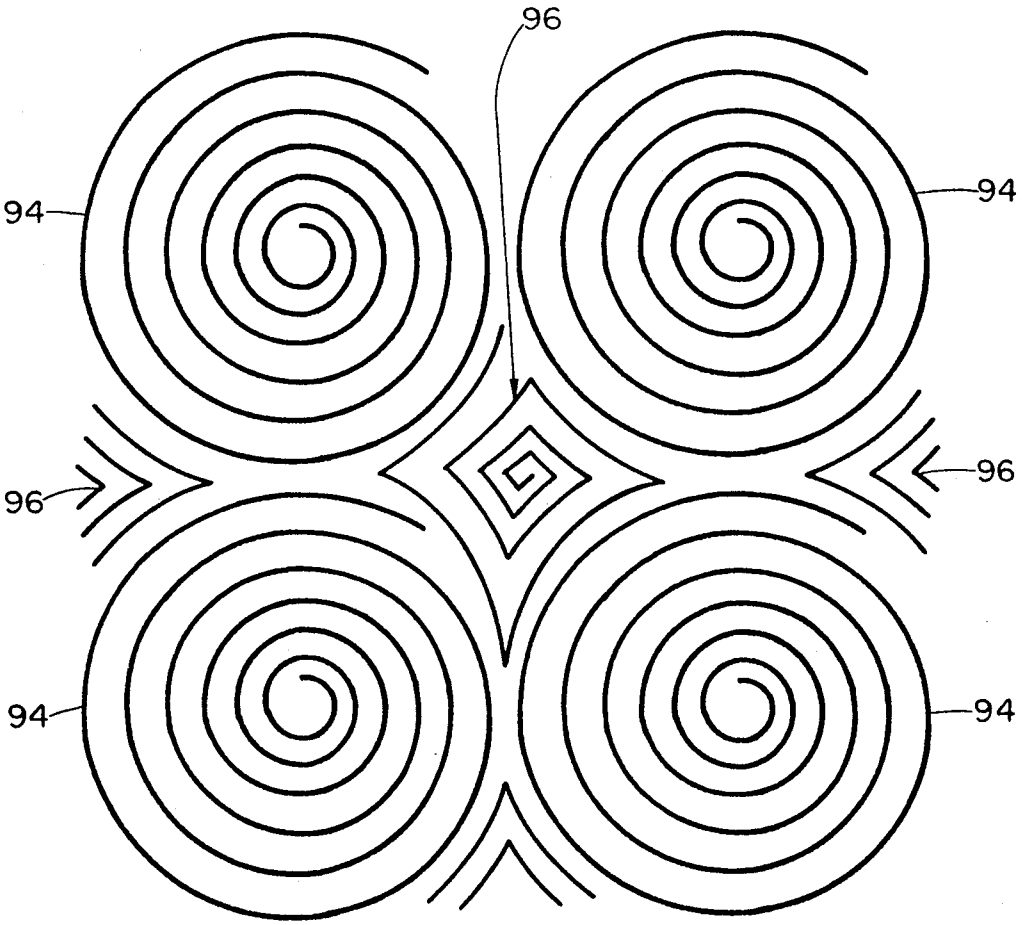
FIG. 28 shows still a further spiral antenna pattern providing good bandwidth absorption and optimizing absorber pattern coverage.

Still further embodiment of the present invention is illustrated in FIG. 28. FIG. 28 also shows a spiral absorber pattern configuration. There are provided a plurality of spiral absorber 94. In association with these spiral absorber patterns there are provided, in interstitial spaces between these spirals, complimentary modified spiral patterns 96. The patterns 96 are not the usual circular spiral but are instead more of a square spiral configuration but having arcuate sides illustrated in FIG. 28 basically matching the maximum diameter of the spirals 94. With this particular spiral configuration, it is noted that there is complimentary matching between the patterns so that virtually the entire surface is covered. This has been found to provide improved broadband operation.

Reference is now made to additional embodiments of the absorber construction particularly ones in which the absorber elements are disposed in a random pattern. This is particularly significant in connection with minimizing grating lobes. Grating lobes which are produced by absorber elements represent unwanted radiation. The construction of the present invention involves a deterministic approach to constructing an array of elements in a random pattern and preferably also an aperiodic pattern. Disclosed herein in at least one embodiment is an array in which the elements have irregular element spacing and unequal element size. This provides for a scattering of the side lobe energy to create a proper reflectivity response.

Figure 29:
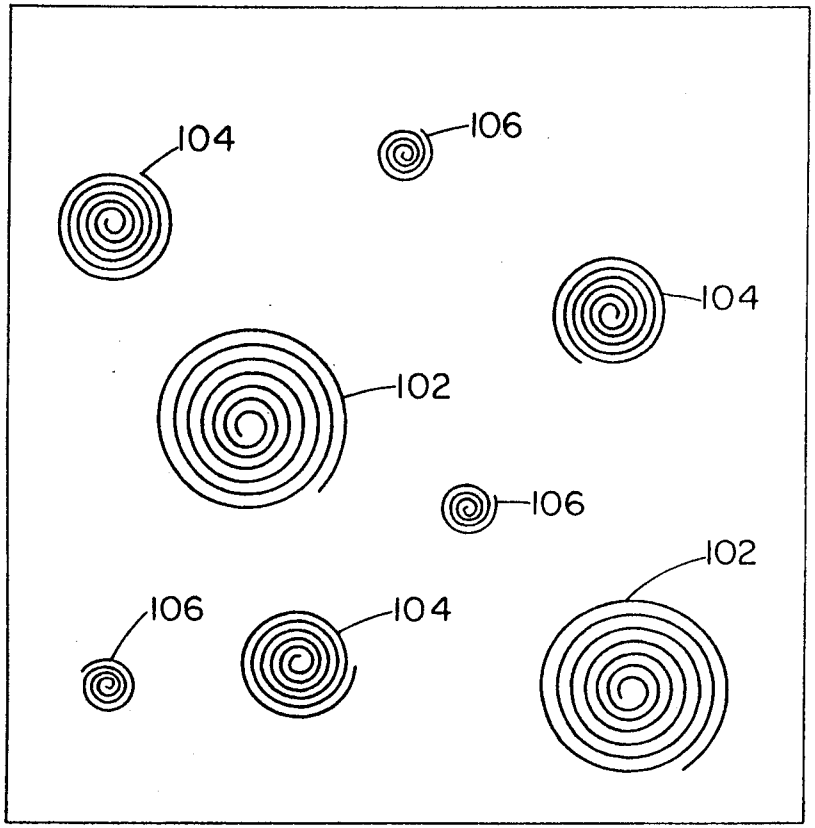
FIG. 29 shows still another pattern of absorber elements particularly spiral absorber elements in which these elements are disposed in a random pattern and in which different size elements are employed.

Now, with particular reference to FIG. 29, it is noted that there is provided an array in which the absorber elements are of spiral configuration and furthermore in which these elements are disposed in a random pattern. The array of FIG. 29 also employs elements that have different spacing therebetween and that are of different size. This includes larger diameter spirals 102, intermediate size spirals 104, and smaller diameter spirals 106.

Figure 30:
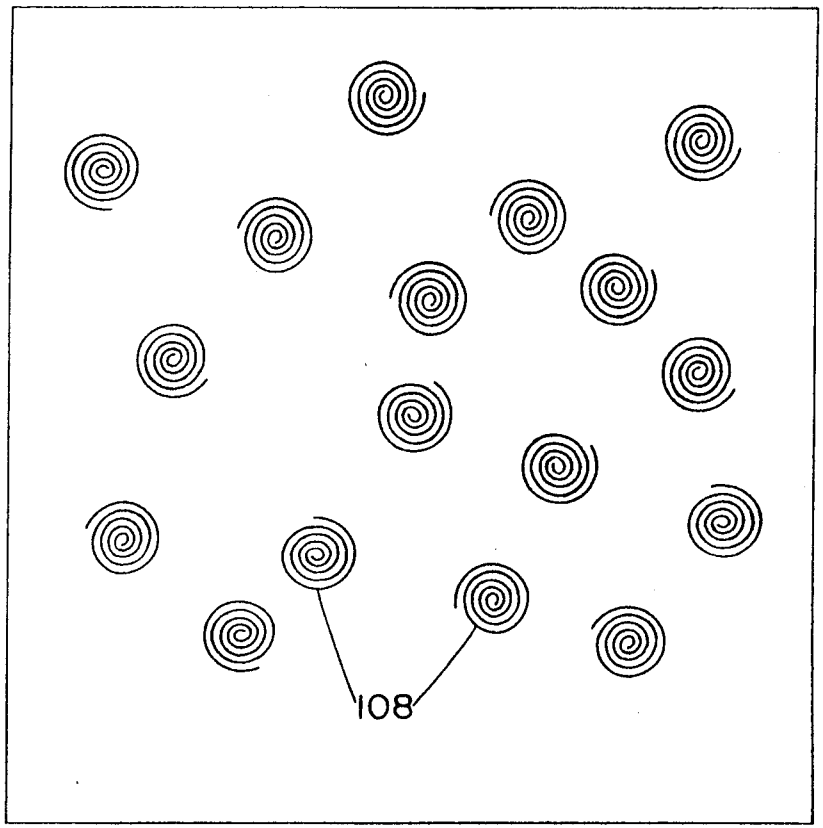
FIG. 30 is a further embodiment illustrating spiral elements in a random pattern but one which includes elements all of the same size.

FIG. 30 also shows a random pattern of spiral absorber elements. In FIG. 30 these elements 108 are all of the same spiral configuration and of the same diameter but are disposed in a random pattern. It is noted in both of the arrays of FIGS. 29 and 30 that for any particular linear line that could be drawn, and for any elements appearing on that line there is no periodicity as far as the center-to-center spacing of the elements are concerned. The spacing between the elements is also preferably selected to be less than ½ wavelength throughout the desired operating frequency band. This is important in reducing the grating lobe signals. Not only the wavelengths spacing but also the randomness of the position of these elements assist in reducing the grating lobe radiation.

Figure 31:
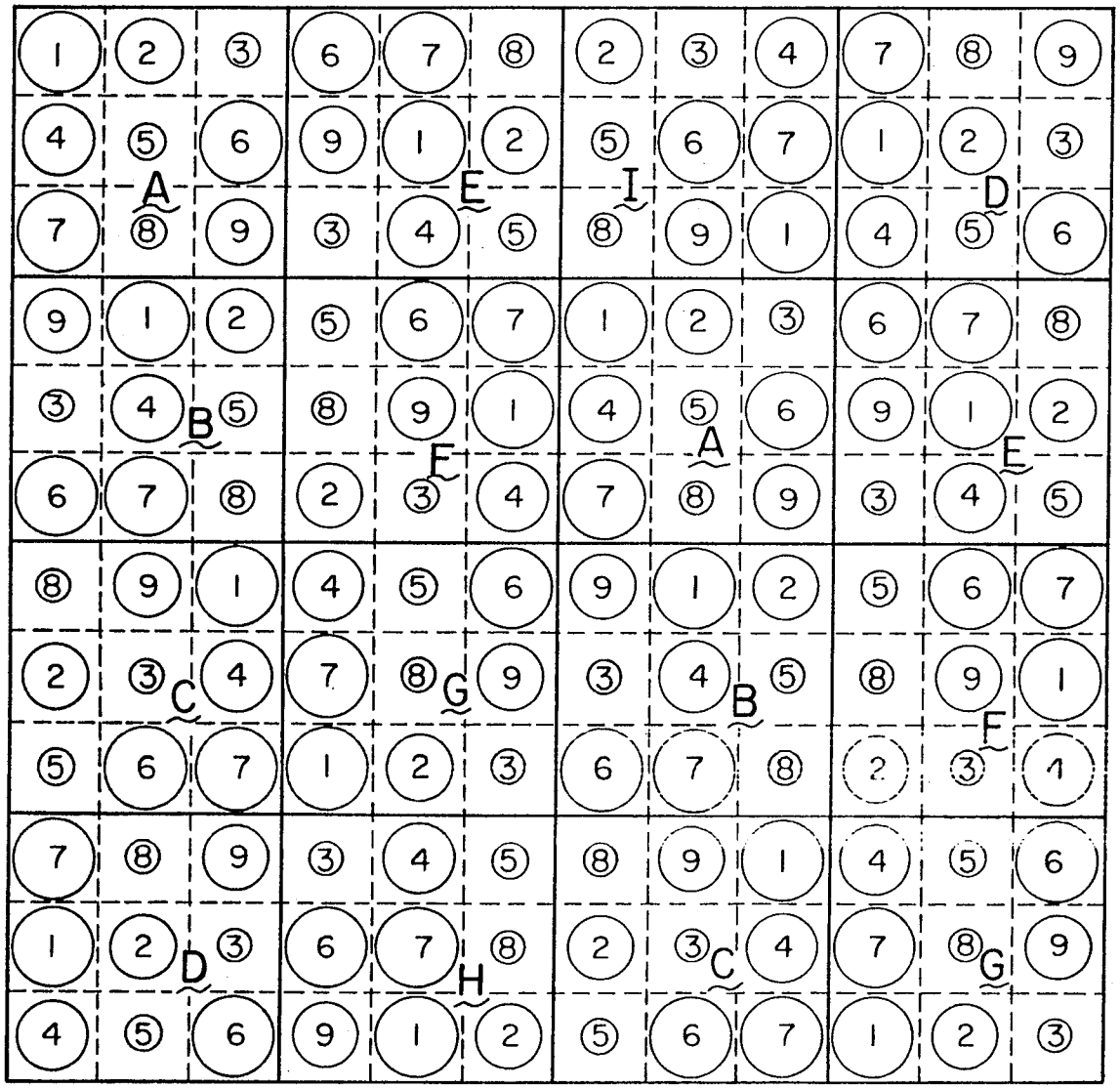
FIG. 31 shows a further embodiment of a random absorber element pattern that is based upon a particular selection algorithm showing the elements schematically and in which these elements may be of various different configurations including spirals and of the various sizes illustrated.

Reference is now made to FIG. 31 for an illustration of a particular algorithm that may be employed in selecting the random position of absorber elements. In FIG. 31 the absorber elements are illustrated schematically simply as discs. The entire array is separated into multiple cells identified as cells A through I. These separate cells are each in an array of three by three with a total of nine elements per cell. Each of the individual elements may be considered as being disposed in a subcell of the main cell.

FIG. 31, as noted therein, also has the elements of three different sizes including large, intermediate, and small size absorber elements. These individual absorber elements are numbered as 1 through 9.

It is noted in FIG. 31 in cell A that the elements are disposed in a particular pattern wherein in the first row there are elements of all three sizes as well as in the second and third rows. However, the position of the different size elements varies from row-to-row.

Considering the next cell B, it is noted that the elements have essentially been displaced by one subcell position so that, for example, the element 1 has now moved to the right by one subcell and the element 9 which was at the lower right hand corner of cell A has now moved to the upper left hand corner of cell B. This continues on through the remaining cell up through cell I. Thereafter, cell A is repeated as noted in FIG. 31. The cell pattern is then repeated from cell A on.

Figure 32:
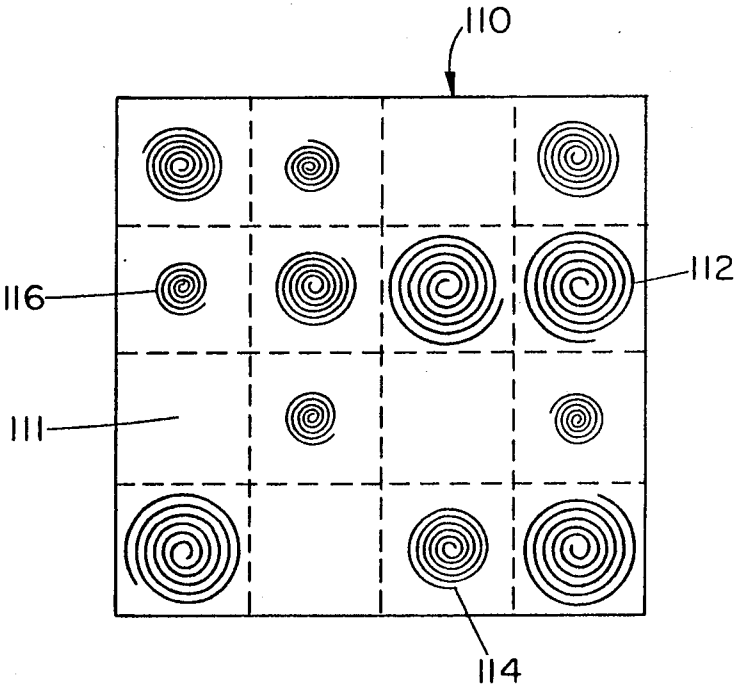
FIG. 32 is still a further alternate configuration for a random pattern of elements illustrating, for example, only one of the cells of FIG. 31 in a four-by-four array with some of the sub-cells vacant so as to make the sequences aperiodic.

It is noted in the embodiment of FIG. 31 that, although the absorber elements are disposed randomly, there is an element of periodicity relating to the center-to-center placement of the subcells. To interrupt this periodicity a pattern such as illustrated in FIG. 32 may be employed. FIG. 32 shows a four by four cell 110 having different size spirals including larger diameter spirals 112, intermediate spirals 114, and small diameter spirals 116. It is noted in this particular random arrangement that certain of the subcells 111 are left blank and in this way the periodicity is interrupted. This is important in suppressing grating lobe radiation.

Figure 33:
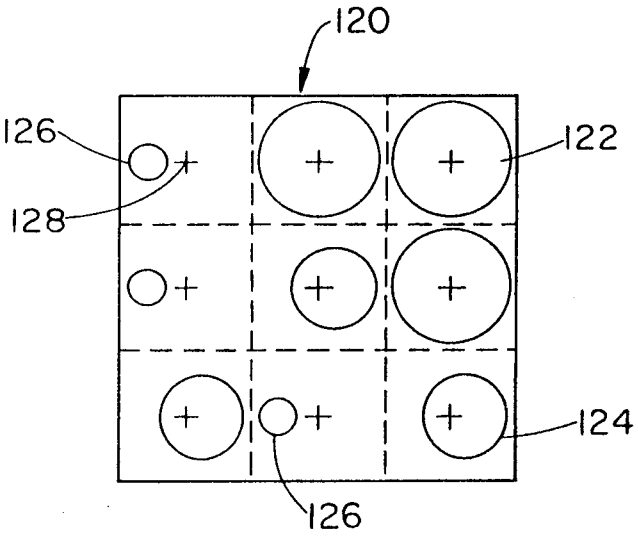
FIG. 33 is an alternate embodiment of the element patterns, such as based upon one of the cells of FIG. 31 but with some of the size elements moved off-center.

Reference is also now made to FIG. 33 showing another technique for providing aperiodicity in the cell. FIG. 33 shows a cell 120 in which the absorber elements are disposed in a three by three array with the elements of different size. FIG. 33 illustrates elements 122 of large diameter, elements 124 of intermediate diameter, and elements 126 of small diameter. In this particular embodiment, the periodicity is made random by virtue of moving the intermediate and smaller size elements off center. In this regard in FIG. 33 refer to the centerpoint 128 of each subcell. It is noted that the smaller diameter elements 126 are moved to the left of the centerpoint in each subcell in which they appear. Also, the intermediate diameter elements 124 are moved to the right of the centerpoint in each subcell that they appear.

In still further embodiments of the present invention combinations can be provided, such as a combination of the embodiments of FIGS. 32 and 33. Also, the elements can be moved off center in various different ways. Also, with regard to the embodiment of FIG. 31 the arrangement of elements can be changed from cell-to-cell employing a different alteration pattern. For example, from cell-to-cell the elements may be moved in the reverse direction or can be moved diagonally or in accordance with some other form of movement pattern to randomize the elements.

Having now described a limited number of embodiments of the present invention, it should now be apparent to those skilled in the art that numerous other embodiments and modifications thereof are contimplated as falling within the scope of the present invention as defined by the appended claims.

What is claimed is:

1. Radar absorbing apparatus for absorbing an electromagnetic energy wave incident thereupon and having frequency signal content in a frequency range including 2–18 GHz, said apparatus comprising;

an electrically conductive reflector means, a substantially planar array comprised of a plurality of discrete and relatively spacially disposed impedance absorber elements, means for supporting said absorber elements from and in front of said electrically conductive reflector means, means for resistively loading the absorber elements, to change the impedance of the absorber elements to alter the gain thereof, thereby decreasing signal re-radiation, said array disposed at a distance measured in the direction of propagation of said electromagnetic energy wave from said reflector means, said absorber elements being disposed in a random pattern array.

2. Radar absorbing apparatus as set forth in claim 1 wherein the absorber elements are disposed in an array absent sufficient alignment of elements so as to prevent grating lobe enhancement occasioned by periodicity of placement of the absorber elements.

3. Radar absorbing apparatus as set forth in claim 2 wherein said random pattern is formed by a plurality of different size absorber elements.

4. Radar absorbing apparatus as set forth in claim 3 wherein said random pattern is formed in a plurality of primary cells each including a plurality of absorber elements, wherein the primary cell size is chosen based on a predetermined reflectivity.

5. Radar absorbing apparatus as set forth in claim 4 wherein, within each cell, there are a like number of absorber elements of each size.

6. Radar absorbing apparatus as set forth in claim 5 wherein n equals the number of different size of absorber elements and $n^2$ equals the number of absorber elements in a primary cell.

7. Radar absorbing apparatus as set forth in claim 5 wherein the arrangement of absorber elements in a primary cell changes to a different pattern in an adjacent cell.

8. Radar absorbing apparatus as set forth in claim 5 wherein the absorber elements in a cell are disposed position-wise in different positions in comparison to an adjacent cell.

9. Radar absorbing apparatus as set forth in claim 8 wherein the absorber element position is displaced by d positions from cell to adjacent cell.

10. Radar absorbing apparatus as set forth in claim 9 wherein d equals one.

11. Radar absorbing apparatus as set forth in claim 1 wherein said random pattern is formed by a plurality of the same size absorber elements.

12. Radar absorbing apparatus as set forth in claim 1 wherein the elements are disposed on aperiodic basis and at least some of said elements comprise spiral elements.

13. Radar absorbing apparatus as set forth in claim 12 wherein said random pattern array comprises a plurality of spiral absorber elements of different diameter.

14. Radar absorbing apparatus as set forth in claim 12 wherein said plurality of absorber elements comprise a plurality of spiral elements of the same diameter.

15. Radar absorbing apparatus as set forth in claim 1 wherein said random pattern is formed by a plurality of different size absorber elements, said pattern being formed in a plurality of primary cells each including a plurality of absorber elements, said primary cell being comprised of a plurality of subcells, the number of absorber elements in a primary cell being less than the number of subcells so as to leave some subcells vacant to inhance aperiodicity.

16. Radar absorbing apparatus as set forth in claim 15 wherein each subcell has a centerpoint and at least some of the absorber elements are disposed off of the centerpoint of a subcell.

17. Radar absorbing apparatus as set forth in claim 1 wherein the random pattern is formed in a plurality of primary cells each including a plurality of absorber elements, said primary cell being subdivided into a plurality of subcells, at least some of said absorber elements being disposed off center in their respective subcells.

18. Radar absorbing apparatus as set forth in claim 1 wherein said means for resistively loading includes means for uniformly forming the absorber element of a layer of resistive material.

19. Radar absorbing apparatus as set forth in claim 18 wherein the resistivity of the absorber element is in the range of $10^{-6}$ to 10 ohms per square.

20. Radar absorbing apparatus as set forth in claim 1 wherein said random pattern is formed by a plurality of different types of absorber elements of equal or unequal size.

* * * * *